US006505557B2

(12) United States Patent
Desaulniers et al.

(10) Patent No.: US 6,505,557 B2
(45) **Date of Patent: *Jan. 14, 2003**

(54) PROCESS TEMPERATURE CONTROL SYSTEM FOR ROTARY PROCESS MACHINERY

(76) Inventors: Ted Desaulniers, 310 Logan, St-Lambert, Quebec (CA), J4P 1H8; John Lovaghy, 96 Napoleon, Mascouche, Quebec (CA), J7L 3B2

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/358,874

(22) Filed: Jul. 22, 1999

(65) Prior Publication Data

US 2002/0112636 A1 Aug. 22, 2002

(51) Int. Cl.[7] ..... B41F 23/04

(52) U.S. Cl. ..... 101/487; 101/216; 101/350.1; 101/350.3

(58) Field of Search ..... 101/487, 141, 101/216, 348–349, 350.1, 187, 350.3; 51/415

(56) References Cited

U.S. PATENT DOCUMENTS 2,971,460 A * 2/1961 Ichikawa ..... 101/348
5,189,960 A * 3/1993 Valentini ..... 101/487
5,315,793 A * 5/1994 Peterson et al. ..... 51/415
5,471,929 A * 12/1995 Frank et al. ..... 101/216
5,611,278 A * 3/1997 Garner et al. ..... 101/349
5,676,754 A * 10/1997 Helms et al. ..... 101/187
5,784,957 A * 7/1998 Rau et al. ..... 701/487
6,109,177 A * 8/2000 Wech et al. ..... 101/487
6,374,769 B1 * 4/2002 Pesavento et al. ..... 101/487

* cited by examiner

*Primary Examiner*—Eugene H. Eickholt
(74) *Attorney, Agent, or Firm*—Eric Fincham

(57) ABSTRACT

A system for controlling a temperature of a rotary machine having a hollow roller chain with ink vibratory rollers and a plate cylinders such as used in a printing head, the system comprising a heat transfer fluid, a device for cooling the heat transfer fluid, a closed loop conduit, a device for passing the heat transfer fluid through the ink vibratory rollers, a solenoid valve mounted on the conduit, the solenoid valve being either fully opened or fully closed, temperature sensors to sense the temperature of the ink vibratory rollers, and a reservoir for the heat transfer fluid. The solenoid valves being either fully opened or fully closed allows for quick and precise temperature adjustments in real-time within a very narrow range.

5 Claims, 14 Drawing Sheets

TO RESERVOIR 36
FROM PUMP 26
TO ROLLERS 38
FROM ROLLERS 38

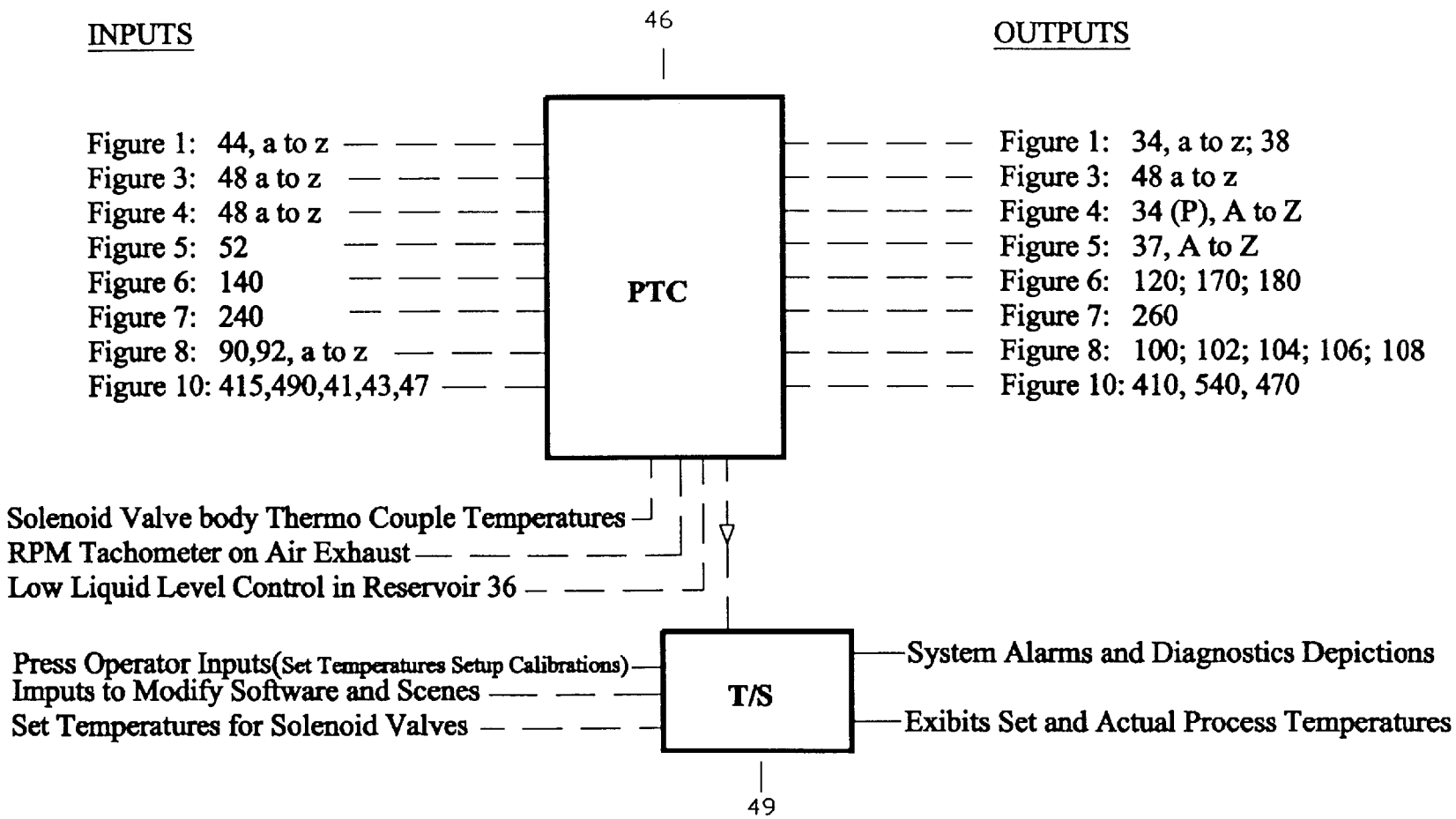
FIGURE 11.1

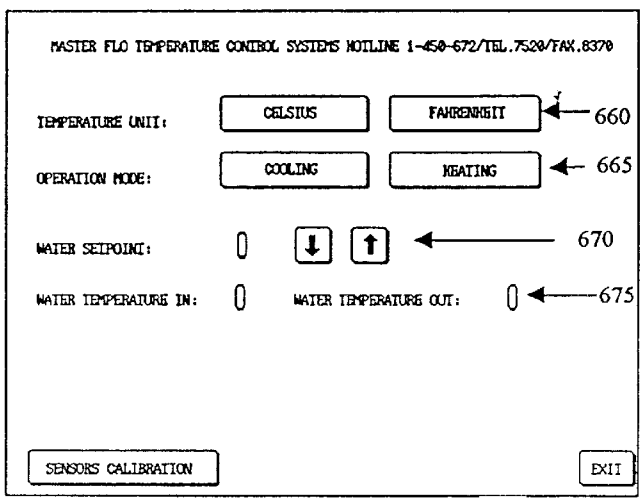
Figure 11.3 Setup
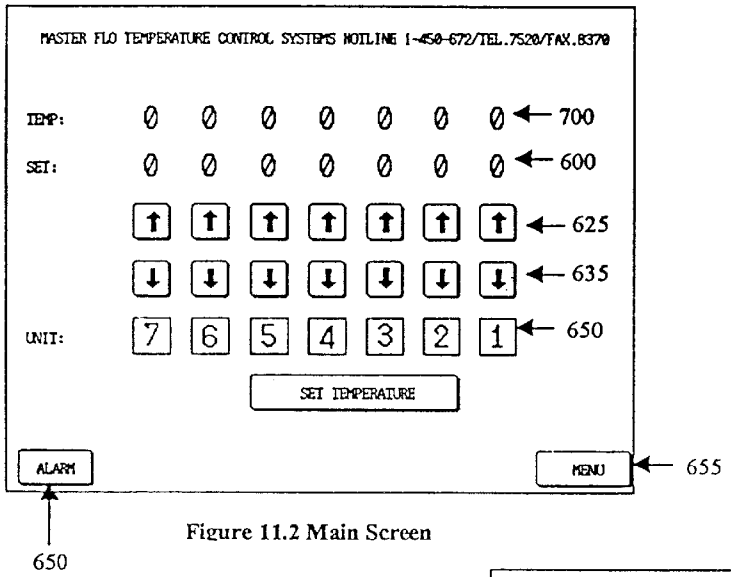
Figure 11.2 Main Screen
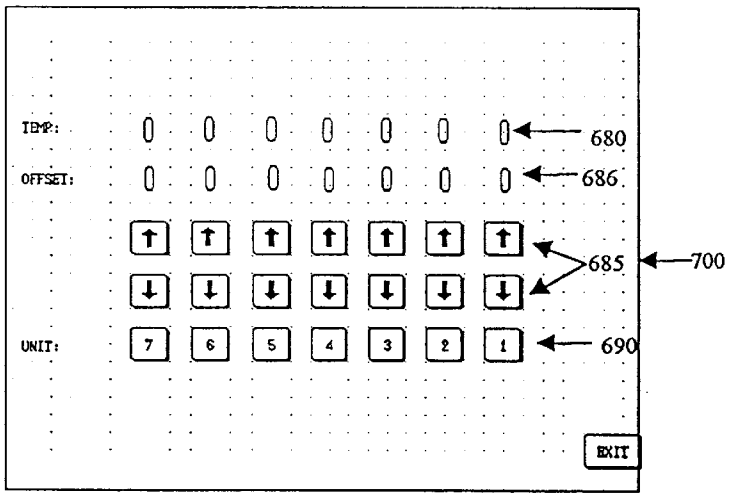
Figure 11.4 Sensor Calibration

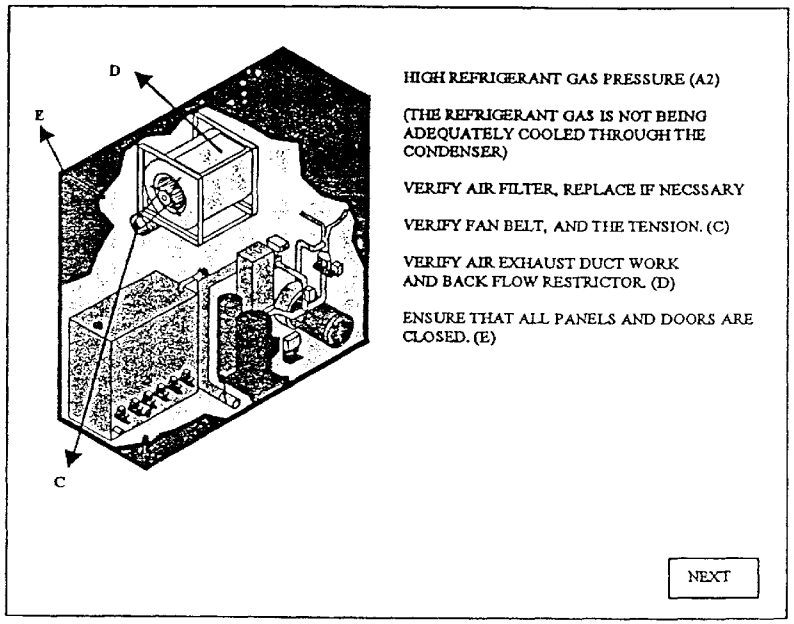
Figure 11.6
High Refrigerant Alarm
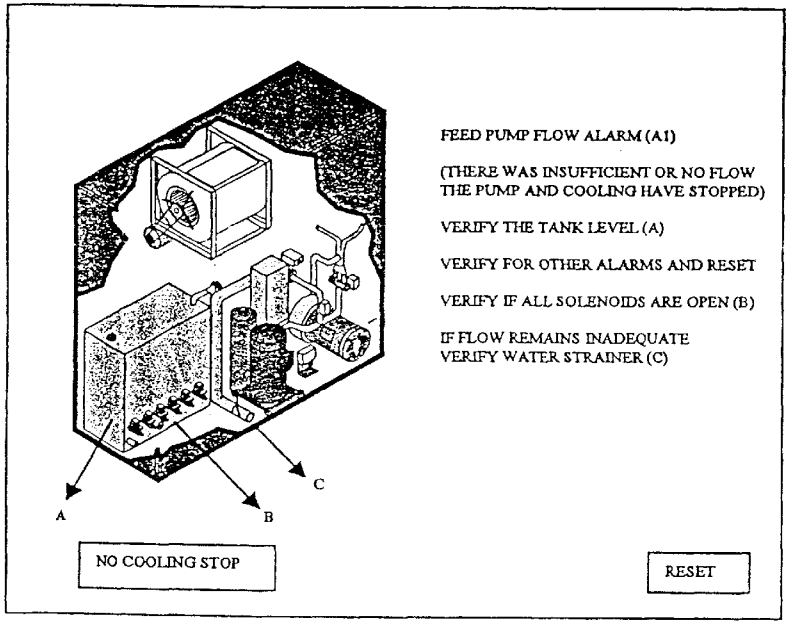
Figure 11.5
Flow Alarm

PROCESS TEMPERATURE CONTROL SYSTEM FOR ROTARY PROCESS MACHINERY

FIELD OF THE INVENTION

The present invention relates to process temperature control for a rotary process machine such as a printing press.

DESCRIPTION OF THE RELATED ART

Rotary printing presses are utilized to reproduce copies of an original copy at a reasonable cost in a rapid and semi-continuous manner by applying ink of assorted colors in a pre-determined "dot" array laid down on a substrate, such as paper, from printing plates. Typically, four process ink colors are utilized in a printing run necessitating, at least, four units of press, one for each ink color. The "dot" array of each ink color is super-imposed adjacent to the other ink colors so that no ink color dots touch each other. This creates an optical image in color, shade and tone of an original. There are various types of rotary printing machines using different printing processes such as gravure, flexography and lithography. Since lithography is the most common printing process used today, this description of the related art and the present invention will focus on the lithographic printing process. However, the related art and the present invention applies to any rotary press process where process fluids, such as ink and dampening solution are utilized.

In lithography, there are two types of printing plates utilized, namely, water based and waterless. Whether this predetermined "dot" array of each ink color is achieved by using conventional lithographic printing plates with oleophilic and hydrophilic areas, the water based type, or waterless printing plates that do not require the water dampening in the conventional lithography process, narrow process temperature control is vital to obtain and maintain consistent quality of each copy produced. Today, printing presses operate at a rate as high as 25 copies per second with so called web rotary offset presses and 5 copies per second with so called sheet-fed offset rotary presses. Once a copy is produced, it is either saleable or waste. The quality of each copy is influenced by many factors such as the typed, adjustment and condition of the rotary press, its accessories equipment, ink, paper and press operator skills. A further very important factor at high press speeds is process temperature control. Effective process temperature control is a real-time issue requiring very fast and accurate process temperature monitoring and adjustments at every instant during each print run. A printing run, defined as the time it takes to generate a desired number of good copies of a specific original, is a pressroom process of setting up the press for this specific print run (make ready), then ramping the speed of the rotary press as quickly as possible while producing a minimum of wasted copies. A print run often involves frequent press stoppages to deal with an assortment of printing problems. Whereas rotary press heating is important for cold press startups, controlled process temperature cooling is continuously important once the press is up to temperature to deal with the process and friction heat loads generated at each press unit. Machine friction heat increases exponentially with press speeds. Process heat loads are generated by ink shearing that takes place at higher press speeds. Prior art in the field of press temperature control ignores the real-time issue of meaningful process temperature control and focuses mostly on general cooling of the rotary press using ink vibrator roller cooling. The paradyns of the printing industry accept this non real-time process general cooling as sufficient. It relies on operator skills to visually inspect copies produced to observe all print quality drifts with which he or she makes appropriate process adjustments. This procedure deals with the real-time effects of process temperature changes rather than treating the cause to eliminate print quality drifts before they occur. The prior art attempts to cool the printing process generally and ink specifically, but makes no attempt to use ink or other process fluids as a coolant towards achieving a more rigid control over process temperatures. Further, and more importantly, the prior art makes no attempt to reach quickly to changes in process temperatures as they continuously occur during each print run. This present invention is dedicated to real-time process temperature control to provide direct control of the color quality of each copy produced.

U.S. Pat. No. 2,971,460 issued to Shindle in 1961 discloses a system for controlling ink roller temperatures of a printing press by circulating cold or hot water through these hollowed out rollers. The purpose of this art is to cool or heat these rollers using water which discharge to a drain using a thermostatic valve that is responsive to the water temperature discharged from these rollers. In addition to its wastefulness of water, no attempt is made, or envisioned, to directly control process temperatures of the press. Rather, this art satisfies its purpose of removing of some of the printing process heat gain in a manner that only responds to the temperature gain or losses of the water to drain. No attempt is made, or contemplated, to directly measure or control any printing process temperature.

U.S. Pat. No. 3,956,986 issued to Burkhandt Wirz et al in 1976 discloses a system to provide control of the temperature of the ink fountain roller and ink vibrator rollers by circulating water through these rollers such that the water discharged from these rollers can be heated or cooled to a preset temperature by adding hotter or colder water before recirculating same back to the press. While this art automates that which was envisioned by U.S. Pat. No. 2,971,460 granted to Shindle in 1961, this art does not attempt or envision to directly monitor or control ink temperatures or other process temperatures.

U.S. Pat. No. 5,272,971 issued to Guenther Fredericks in 1993 discloses a system to provide ink temperature control for lithographic printing by using a non contact sensor at the ink vibrator rollers and at the plate cylinder roller to operate a PID controlled valve which adds cool and hot water to the coolant supplied to the printing press to achieve a preset temperature for delivery to the vibrator rollers of a press. While the inventor of this art claims that this method of controlling the coolant temperatures is substantially continuous, rapid and energy efficient, this art cannot be quicker to maintain process temperatures than the speed at which the coolant temperature is adjusted by the addition of cool or hot water. As a result, this art is too slow to control the process temperature of the ink at the ink vibrator rollers in real time and even more slow to adjust process temperature control at the plate cylinder of a printing press where no coolant is circulated.

U.S. Pat. No. 5,189,960 issued to Frederic Valentine in 1993 discloses a system for controlling the temperature of the printing plates on the plate cylinders of a rotary printing press using closed loop heater and cooler units with controllable mixing valves to provide a desired temperature coolant fed to the ink oscillator rollers of a printing press. The controlled coolant mixture cools or heats the ink and in turn, the ink cools the printing plate at the plate cylinder. This art is a system similar to U.S. Pat. No. 5,272,971 in that it attempts to control the ink temperature at the ink vibrator rollers using a controllable mixing valve, non contact temperature sensor and a temperature controller to automate the temperature control process. This art is also too slow acting to provide process temperature changes in real time.

U.S. Pat. No. 5,611,278 issued to Steve M. Garner in 1997 discloses a system that controls the ink temperature of a printing plate and ink vibrator rollers of a printing press using non contact sensors interfaced to an electrically operated valve placed in the coolant flow circuit to and from the ink vibrator rollers. This art envisions achieving process temperature control by varying the coolant flow rate to the press in real-time. The electrically operated valve is connected to a controller that actuates the electrically operated valve causing it to open or close incrementally in response to process temperature changes. This art is not concerned with rapid cooling/heating responses in real time since electrically actuated valves are, by design, slow to respond to commands. Further, this art increasing or decreasing the flow rate of coolant to the ink vibrator rollers in real-time in response to PID commands from process temperature observations at the printing plate cylinders. This art attempts to incrementally increase or decrease ink temperatures by adjusting coolant flow rates to the ink vibrator rollers and slowly reacts to dampen the increases in temperature of the process. Therefore, this art does not react sufficiently fast in real time to rigidly control ink temperatures or process temperatures.

In water based lithography, a conventional printing plate is mounted on each plate cylinder of each unit of press. A film of water based dampening solution is first applied on each printing plate over which ink is secondly applied. This dual layer of water and ink are transmitted to a substrate with every full rotation of the plate cylinder. The oleophilic areas of the printing plate repels the water based dampening solution and attract the ink. Its hydrophilic areas attract the dampening solution and repel the ink. In this way, ink is deposited in a "dot" array on the printing plate which is then transferred to the substrate via a blanket roller. The ink dots of each color, usually four base colors, are precisely placed adjacent to one another to create an optical image of an original copy in matching colors and tones.

In waterless lithography, the printing plate is a different design than water based lithography in that the waterless plate does not require water based dampening solution. The non-print areas of a waterless printing plate are specially coated to not attract ink. By design, these waterless printing plates are more temperature sensitive than conventional plates. In addition, the absence of the temperature dampening effect of dampening solution with waterless plates increase their sensitivity to process temperature changes. Therefore, process temperature control is a more critical concern with waterless lithography. At low press speeds, process temperature control is not so vital using either type of printing plate, since frictional heat is relatively small and ink-shearing heat is non-existent. However, at the high speeds of modern day printing presses, frictional heat and ink shearing heat are huge and these huge heat gains impact negatively on print quality for water based and waterless lithography alike.

Without limiting the foregoing, the lithographic process lays down dots of ink of different colors on a substrate using a plurality of press units, at least, one press unit per color. The precise arrangement of individual ink dots of different colors, adjacent to one another, results in a visual image on the substrate in the color, tones and shape of an original copy being replicated. The quality of the image on each printed copy depends on the sharpness of each ink dot on the substrate. In turn, dot sharpness depends on the quality/quantity control of fountain solution and ink used and the process temperature under which each dot is created. An increase in process temperature tends to spread each dot and distorts the visual image produced. These distortions occur for a host of reasons such as operator changes to the amount of dampening solution to correct for observed printing defects in the copies being produced or the increase in the fluidity of the inks due to process temperature increases and/or press machine misalignments caused by process temperature changes in real-time. In waterless lithography, the absence of dampening solution eliminates the probability of ink distortions caused by wetting the substrate and emulsification of the inks. However, the absence of the cooling effect of dampening solution with waterless printing plates increases the sensitivity of waterless printing plates to process temperatures changes.

As mentioned, modem day lithographic process is a very high-speed semi-continuous process that produces finished copies at a rate as high as twenty-five copies per second. This is too fast for manual control of print quality due to process temperature changes. Since the quality of each copy is heavily influenced by the process temperatures under which it was processed, it is imperative that process temperatures be maintained within very narrow ranges in real time throughout each printing run. The ink shearing which only takes place at higher press speeds adds to the necessity of quick-acting control process temperatures in real-time. Ink shearing, which is the tearing apart of ink molecules, is a heat generating process which increases the difficulty of maintaining process temperatures within range. Also ink shearing changes the chemical characteristics of the ink and this further degrades print quality in real time.

Some print authorities believe that ink temperature control within the range of ±7° F. provides sufficient process temperature control for good print quality standards. Increasingly, the majority of print authorities realize that color consistency is being held within an acceptable range through the continuous manual process adjustments which are made necessary by process temperature drifts. Accordingly, print authorities are slowly accepting the process temperature control to ±2° F. provides steadier print quality while reducing the frequency of press adjustments by as much as 80%. To achieve this tighter control of process temperatures, abundant cooling power with quick acting cooling flow rate control coupled with accurate and direct process temperature monitoring in real-time is essential.

Apart from the inability of all the prior art described by U.S. Pat. Nos. 5,611,278; 5,189,960; 5,272,971; 3,956,986 and 2,971,460 to be quickly responsive to process temperature changes, the first three listed purport to control the temperature of the plate cylinder in real time by controlling the heating or cooling applied at the ink vibrator rollers. The investigations by the inventors of the present invention show that these first three prior arts do not provide sufficiently rigid process temperature control at the plate cylinder of a printing press in real time at high press speeds. At best, these arts monitor printing plate temperatures and slowly react to correct for process temperature changes; a marginal improvement to the art that pre-existed them.

During a press run, the press itself is a huge heat source. In the rare instances where an increase in the print plate temperature is desired (such as cold press start-ups), this printing plate heating is quickly and naturally achieved by the actual heat generated in the printing process. However, controlling plate temperatures within a range of ±2° F.

requires a new means to instantly and completely stop and start abundant coolant flow being supplied to the ink vibrator rollers and/or plate cylinders to have quick process temperature control impact. When a decrease in the printing plate temperature is instantly required, this cooling can be achieved by supplying external coolant at full flow to reduce the temperature of the ink vibrator rollers and/or plate cylinders of each printing press unit with a very fast acting ability to fully stop this flow. Unless direct coolant flow for cooling/heating can be circulated at the plate cylinders, the quick response cooling or heating at one place (ink vibrator rollers) has only a slow and indirect impact at another place (the plate cylinder). If a printing press is designed to receive direct cooling/heating at the plate cylinder rollers, the preferred embodiment of this invention includes the delivery of coolant to the plate cylinder rollers to control the plate temperatures to a desired set temperatures using the exact same process temperature control system as is proposed for the ink vibrator roller cooling/heating system of this present invention. In this aspect of the present invention, the plate cylinder temperature control takes precedent over ink vibrator roller temperature control since temperature control at the printing plate is more critically related to the quality of the copies actually produced. Therefore, when the plate cylinders are cooled directly, the temperature settings of the ink vibrator rollers would automatically decreased or increased under PID control to assist in narrowing the range of process temperatures at the plate cylinder while maintaining the ink temperatures at the ink vibrator rollers within an acceptable range that will not result in roller sweating and will not impact negatively on the inks characteristics.

SUMMARY OF THE INVENTION

The first objective of the present invention is to provide a system to regulate ink temperatures at the ink vibrator rollers and/or the plate cylinders of rotary printing press in real time within a narrow range of set temperatures to optimize the chemical characteristics of each ink color, maintain color consistency in the printed copies, reduce the frequency of manual press adjustment interventions by printing press operators and reduces wasted copies. The second objective of the present invention is to assist the temperature control of the first objective by controlling the temperature of dampening solution supplied to the plate cylinders. The third objective is to provide temperature control over other sources of process heating and to control the temperatures of other process constituents.

In most aspects of the present invention, the temperature control system includes a pump driven coolant circulation system in a closed loop connecting the ink vibrator rollers and/or plate cylinder rollers of each unit of a rotary printing press to a reservoir of a central cooling/heating unit heat pump in a way that very high rates of external coolant flow are instantly available at full flow or no flow (on/off) to these press rollers. This coolant flow rate is precisely controlled with reference to the ink temperature monitored at the ink vibrator rollers and/or at the plate cylinder by ink temperature sensors at each. These temperature sensors are coupled to a temperature controller. In the preferred embodiment of this invention temperature sensors for monitoring process fluids are infrared non-contact sensors. However, any type of temperature sensor will suffice as long as it consistently and dependably monitors ink temperatures in real time.

In a first aspect of the present invention, the so called multi-zone ink vibrator roller temperature control system, a main normally open solenoid valve in the coolant circulation system is placed between the coolant discharge from ink vibrator rollers of the rotary printing press and the coolant circulation reservoir. This main solenoid valve, or a plurality of them (one per press unit), is coupled to a temperature controller in reference to a non-contact sensor that monitors the ink temperature at each set of ink vibrator rollers. A high flow rate central coolant pump operates continuously taking its suction from the reservoir and feed the ink vibrator rollers. A secondary normally closed solenoid, one for a plurality of press units, is placed between the discharge of the circulation pump and the coolant reservoir to serve as a bypass coolant flow conduit. This secondary bypass solenoid is coupled to the temperature controller and is programmed to open when 30% or less of the circulation through the main solenoid valve(s) are open. This bypass arrangement provides for a continuous pressurized coolant circulation system at the ink vibrator rollers and/or plate cylinders whose coolant flow may be completely, and instantly, stopped or started without dead heading the continuously operating circulation pump. The coolant circulation pump typically supplies three ink vibrator rollers per unit of press and a plurality of such press units. Also, the circulation pump continuously supplies approximately 15% of its coolant discharge to a heat exchanger regulated by an inline flow regulator where this continuous coolant flow is either cooled or heated by the refrigerant of a heat pump and delivered to the coolant reservoir in a closed loop. In a preferred embodiment of this present invention, one non-contact infrared sensor monitors the ink temperature at one of the ink vibrator rollers and/or plate cylinder of each press unit. The process temperature is achieved by the rapid "on/off" operation of a main solenoid valve in the coolant flow line returning from the ink vibrator rollers of each unit of press to the central coolant reservoir. Each infrared sensor/main solenoid valve set, one set per press unit for a plurality of press units, is coupled to a temperature controller so that the printing press operator can manually set the ink temperature he desires at each unit of the press based on his experience. The temperature controller in the preferred embodiment of this present invention is a central programmable logic computer (PLC) interfaced to a color touch screen and coupled to an infrared non-contact sensor to control each main normally open solenoid valve and the bypass solenoid valve. This first aspect of the present invention is called a Multi-Zone Ink Vibrator Roller Process Temperature Control System.

In a second aspect of the present invention, a plurality of printing units is supplied with coolant circulation using only one main normally open solenoid valve and one infrared sensor. This embodiment of the present invention is called an Omni-Zone Ink Vibrator Roller Process Temperature Control System.

In a third aspect of the present invention, a non-contact infrared sensor is also placed at the plate cylinder of one press unit (Omni-Zone System) or at a plurality of plate cylinders (Multi-Zone System). Typically, plate cylinders are not designed to receive coolant. Nevertheless, it is desirable to maintain this plate cylinder temperature within a specific temperature range at each press unit. The desired temperature at a plate cylinder depends, amongst other factors, on the chemistry and characteristics of the ink used. When the printing plate cylinders are not designed to receive coolant, the plate temperature is controlled in this aspect of the present invention by cooling the ink at the ink vibrator rollers on each press unit and the ink becomes the source of cooling at the printing plate cylinder. In such cases, the desired temperature range for each printing plate cylinder is manually input into the program of the temperature controller. In this way, the actual temperature reading at the infrared sensor at the printing plate in relation to the set temperature range provide an alarm signal for the press operator when the actual ink plate temperature reaches either limit of the pre-set temperature range and this for a plurality of printing plate cylinders. Upon receiving an alarm signal, the set ink temperatures at the ink vibration rollers may be manually reset, or managed automatically under PID control, to quickly and directly generate more or less cooling of the ink vibrator rollers to indirectly impact on the plate cylinder temperature.

In a fourth aspect of the present invention, coolant is also directly supplied to the plate cylinder, in cases where the press design permits using the coolant circulation flow to the ink vibrator rollers or using an independent coolant circulation stream dedicated to the plate cylinder or a plurality of plate cylinders.

In a fifth aspect of this present invention, process temperature control is enhanced as compared to the first and second aspects of this invention, Multi-Zone and Omni-Zone systems, by controlling the temperature of dampening solution associated with conventional printing plates as an second process fluid to cool the printing process. Typically, dampening solution is supplied to a printing press using known art called a fountain solution recirculator system. Increasingly, these recirculator systems include a mechanical refrigeration system to issue this fluid to the dampening systems of a printing press at some desired dampening solution temperature. This prior art makes no attempt was made to directly control process temperatures. This known art is intended to cool the dampening solution to some set temperature to assist in the essential formation of a microthin film of dampening solution on the printing plate. Any breach in the quality of this dampening solution film results in defects in coverage on the hydrophilic areas of the printing plate and yields unacceptable printed copies. Actually, temperature changes at the printing plate, and this in a plurality of press units, cause breaches in the dampening solution film coverage. Given that printing plate temperatures often cause these film breaches, dampening solution temperature at the printing plate is directly monitored in this aspect of the present invention by a plate cylinder infrared sensor coupled to an alarm as previously described in the third aspect of this present invention. This alarm signal permits manual temperature adjustments to the dampening solution being issued to the printing press. Alternatively, if the plate cylinder infrared sensor is coupled to a PLC/Touch Screen, this manual control can be automated using P.I.D. control. This dampening solution recirculation system may be combined with a process temperature control system as described in the four prior aspects of this present invention. This combo may be housed in a single footprint unit saving valuable floor space. More importantly, this aspect of the present invention uses dampening solution as a process fluid to contribute to meaningful process temperature control system.

In a sixth aspect of this present invention, a heat exchanger is added to the heat pump design of its preferred embodiment to provide a source of cooling control for an infrared/ultraviolet dryer system which is commonly used to set inks on the printed copies in the print copy delivery system. This closed loop separate dryer coolant flow consists of a circulation pump in continuous operation, an expansion tank and the above-mentioned heat exchanger. The dryer internal coolant absorbs the extraneous heat generated by the infrared/ultraviolet lamps of a dryer system. This hotter internal dryer coolant is then cooled at the heat exchanger by the external coolant that is also supplied to the ink vibrator roller/plate cylinder coolant flow paths of the first five aspects of this present invention. In this aspect, a thermocouple temperature sensor in the dryer internal coolant flow path (hot) returning from the dryers to the heat exchanger is coupled to a temperature controller. In turn, the temperature controller is coupled to a solenoid valve in the external coolant path (cold) to control the temperature of the dryer internal coolant. Without this sixth aspect in printing applications using ultraviolet or infrared dryers, the dryer heat impacts negatively on process temperatures.

The first six aspects of this present invention elaborate on ways and means to provide effective process temperature control for a rotary process machine which uses process fluids to manufacture a product such as printing (ink, dampening solution and coating material). Secondarily, the use of external cooling and heating coolant meaningfully assists a rotary machine to reach and maintain some ideal temperature in a timely fashion at which the machine operates best. While the descriptions of the present invention use process fluids themselves as a conduit of cooling or heating as required and uses external coolant to cool/heat the rotary machine and process fluids alike, the sixth aspect of this invention deal with the control of a heat source other than the principal ones of machine friction heat and heat generated by misting of a fluid (ink). Such sources of external heat as a by-product of achieving secondary end results is quite common in rotary production machines. In fact, there are other sources of process temperature disruption associated with printing such as the use of high volume low pressure air generated by turbine pumps. These turbine pumps in turn, generate tremendous unwanted heat delivered to the printing process by the low pressure high volume air. This source of unwanted heat may be cooled by the preferred heat pump of the present invention or by a system similar to the eighth aspect of the present invention. Accordingly, this present invention covers the control of any source of unwanted cooling or heating which negatively infringes on process temperature control.

In a seventh aspect of this invention, a separate heat exchanger is added to a pre-existing coating fluid system to control the temperature of fluid coating material used in printing process. In such cases, the external coolant flows of the prior six aspects of this present invention is used to cool the coating material in its own reservoir. Typically, coating fluid is applied to the substrate by a dedicated printing unit positioned after all ink process colors have been applied. This coating material is typically supplied in a closed loop continuous flow system compromising of a circulation pump to move this fluid to the coating press unit from which the excess coating material is returned to the coating reservoir. This is prior art except for the cooling of the coating material. Coating fluid temperatures tend to rise above its ideal temperature (i.e. 75° F.) due to the heat gained by the coating material from the rotary printing machine. In this seventh aspect of the present invention, a thermocouple temperature sensor is placed in the coating fluid flow path (hot) from the coating reservoir and pump and before it entering the heat exchanger emits path to the coating press unit. External coolant is pumped to the heat exchanger as it is pumped to the press units of all prior aspects of this invention. This external coolant flow rate is controlled by a solenoid valve placed after the heat exchanger in its flow path back to the external coolant reservoir. Typically, there is only one coating press unit for a plurality of printing press units and the coating material is a varnish or silicone product to create a protective glossy finish coating after all ink colors have been applied.

In an eighth aspect of this present invention, the central heat pump system of the preferred embodiment of this present invention is replaced by a stand alone refrigeration system such as an existing large water based chilling system. Typically, these large chillers are used for other pressroom applications such as baking ovens for heat set inks used in web press applications. It is also common practice today to use these large chilling systems to cool web printing presses through the ink vibrator rollers at each unit of press using known art as described by U.S. Pat. No. 3,956,986 issued to Birkhandt Urliz et al in 1976. Typically, these ink vibrator roller cooling/heating systems use the chill water of this central chiller and a circulation pump to conduit this chill water to the ink vibrator rollers and discharges back to the main reservoir of the central chiller system. Often, an electric probe heating element in the ink vibrator rollers, and a thermocouple in the coolant discharge from the ink vibrator rollers, both coupled to a temperature controller, are used to meet coolant heating needs. If the coolant discharge temperature from the ink vibrator rollers increases above a set temperature, i.e. 75° F., chill water from the central chilling system is added to the coolant circulated to the ink vibrator roller in order to reduce its coolant temperature at the exit from the ink vibrator rollers to the set temperature (75° F.). If the coolant discharge temperature from the ink vibrator rollers is less than 75° F., which occasionally occurs when a press has not been in operation for a long period, the central chiller water source is closed off and the closed loop water circulating to the ink vibrator roller is heated by the electric probe heater to 75° F. Typically, one such standard cooling/heating system is used for a plurality of press units. However, even if there is one such system for each unit of a press, this design is not capable to provide rigid process temperature control at the present day elevated press speeds up to 25 copies per second. The inventors of this present invention found that ink temperatures at the ink vibrator rollers of a web press varied by as much as 18° .F at press speeds of 2500 feet per minute over a two-hour test period using this typical central standard central chiller system with the prior art as described by U.S. Pat. No. 3,956,986 issued to Birkland Urliz et al in 1976. In this aspect of the present invention, the full power of the central chill water is issued to the ink vibrator rollers and/or plate cylinders without regulating its temperature at the discharge of the ink vibrator rollers. Typically, chill water for a central chiller unit is set at 50° F. or lower. From these ink vibrator rollers, the chill water of this present invention returns directly to the central chilling system's reservoir impeded only a solenoid valve per press unit or per press. Typically, the chill water returning to the central chiller's reservoir is approximately 200 gallons per minute at 2 to 3° F. higher in temperature than the chilled water entering the ink vibrator roller from the central chiller system. This large flow rate at a low temperature is a huge source of cooling power previously untapped. The preferred non-contact infrared temperature sensor monitoring the ink vibrator rollers of this present invention is coupled to a temperature controller and operates the above mentioned solenoid valve(s). Since web presses typically perfecting print simultaneously on both sides of a substrate, using an upper and lower section of each press unit; a non-contact sensor is preferred for each set of ink vibrator rollers and each plate cylinder of each unit of a press and this for a plurality of press units. Each set of ink vibrator rollers and/or each printing plate cylinder has its own coolant discharge impeded only by a solenoid valve coupled to the temperature controller. Since the heat generated in the upper and lower section of each press unit is never the same at any press speed (due to such factors as different mechanical design tolerances, mechanical adjustments/wear, different amounts of ink coverage at each and different ink shearing heat levels), the preferred embodiment of this aspect of this present invention is where there is separate control for the ink vibrator roller train and/or each plate cylinder of the upper and lower section of a perfecting web press. This is achieved by the inclusion of a main solenoid valve on the discharge side of the coolant flow path from the ink vibrator rollers of the upper section and another for the lower section of each press unit and/or each plate cylinder. In the preferred embodiment of this aspect of this invention, using the ink vibrator. roller system as an example, a continuously operating pump for a plurality of press units is used to ensure maximum coolant flow to each set of ink vibrator rollers. This coolant flow is fully stopped and instantly started at each set of ink vibrator rollers by a normally open solenoid valve in the coolant discharge from each set of ink vibrator rollers to the central chiller reservoir. One non-contact temperature sensor associated with each set of ink vibrator rollers coupled to temperature controller controls its associated normally open coolant solenoid valve. Should only 30% or less of these solenoid valves be open at any instant, a normally closed by-pass solenoid valve (one per press) is automatically opened to maintain flow to protect against coolant flow pressure dead heading at the circulation pump. The preferred embodiment of this aspect of the present invention is called the Web Multi-Zone ink vibrator and plate cylinder Temperature Control system in which each set of ink vibrator rollers and each printing plate cylinder is controlled separately. This preferred embodiment of this invention may be amended to an Omni-Zone system as described in the second aspect of this present invention such that the coolant flow to all units of a press is controlled by an infrared sensor at the ink vibrator rollers and/or plate cylinder, of the upper or lower roller trains, or both, of a pre-selected specific of a web press. If press heating is required during cold startups, a closed loop coolant flow to the ink vibrator rollers is set up using the above circulating pump, an additional coolant reservoir, an electric probe and the same conduit path as when in a cooling mode. When the system is in heating mode, the supply and return conduits path of the central chiller system to the printing press are closed by solenoid valves coupled to a temperature controller. In this case, the non-contact infrared temperature sensor (s) coupled to the temperature controller activates the electrical probe heat (usually 10–15 kw-hr) to heat the coolant to increase the ink temperature as desired. This closed heating flow loop pre-warms the printing press to permit faster ramping of press speeds with fewer mechanical press adjustments than would be necessary to increase the process temperature from below normal to ideal during cold start-up period ramping.

In the ninth aspect of the present invention, the preferred embodiment of this present invention includes non-contact infrared mirror type sensors. These infrared sensors are known art. However, infrared sensors are typically manufactured to ±4° C. variance between their temperature reading and the actual temperature sensed. This is an unacceptable accuracy range for process temperature control since the object of process temperature control system of this present invention is to maintain process temperature within a range of ±1° C. (±1.8° F.). Investigations under this present invention showed that the repeatability of readings from a quality infrared sensor is within a ±1° C. range. That is to say, if a reading from a given infrared sensor is 3° C. higher (i.e. 88° F.) than the actual temperature (85° F.), it will repeatedly read 3° C. higher within a range of actual temperatures of ±5° C. (i.e. 80 to 90° F.). When a programmable logic computer (PLC) is included, the preferred embodiment of this present invention includes software to calibrate each non-contact infrared sensor so that it will accurately monitor temperatures to ±1° F. As a result, the non-contact infrared sensor of the preferred embodiment of this present invention provides accurate process temperature information so that the decisions of the press operator conform to process realities. It also provides for easy infrared temperature sensor re-calibration in the field. Further to this, the preferred non-contact infrared sensor is a mirror type infrared sensors for cleanliness and low maintenance upkeep. As discussed earlier, ink shears at high press speeds. Apart from the detrimental heat produced by ink shearing, the tearing apart of ink molecules, this phenomena results in visible ink misting into the pressroom environment. While the ±1° C. process temperature control provided by this present invention actually reduces the amount of ink misting during a print run (and therefore reduces the negative impact on the environment and printed copies produced), a means must exist to prevent the laying down of particles of ink from misting on the non-contact sensor components and its mirror. The mirror of the non-contact infrared sensor permits the monitoring of temperature readings of an ink surface that is parallel to the cylindrical infrared sensor. The infrared wave emitted by the ink surface on the press rollers is bent by the mirror place at 45° so that the wave direction is changed by 90° and runs parallel to the ink surface. The mirror assembly is a hollow cylinder that screws on to the end of metallic cylindrical infrared sensor and contains a mirror placed at 45% to the hollow cylindrical tube. This is known art. With this design, the mirror assembly when screwed onto the main cylindrical sensor deflects the infrared wave by 90° so that it travels along the center of the cylindrical sensor to the sensors measuring device. The mirror assembly has an elliptical opening in its hollow cylindrical body through which the infrared wave beam can be received from the point where the ink temperature is being measured. The preferred embodiment of this present invention provides for an air curtain across the outer periphery of the hollowed cylindrical body of the mirror assembly at the elliptical opening. This air curtain prevents ink misting particles from entering and depositing on the infrared components (including the mirror of the mirror assembly). Commonly, print rooms use dry, cleaned compressed air to operate pneumatic equipment and controls in their process. This quality central air source is regulated to 2 or 3 psia and issued across the face of the elliptical opening to the mirror creating an air curtain to prevent the deposit of ink misting or other contaminants on the mirror and the main components of the infrared sensor assembly. Alternatively, the pressurized air can be made to enter the hollowed cylindrical infrared sensor such that the air flows to the mirror assembly and exits at the elliptical opening. This outward air flow from the infrared sensor insures non-contamination by ink misting without disrupting the sensors normal accuracy.

In the tenth aspect of this present invention, the preferred embodiment of this present invention includes a central efficient heat pump source of cooling or heating for the coolant circulated to the rotary printing press where the latter's flow rate is abruptly started and stopped in real time. Practically and usually, a printing press is either heated for an extended period of time such as during a start up period (first hour or so) or cooled continuously after a start up period until a given print run is completed. In other words, cooling is not required at all during cold press start-ups and heating is not required thereafter. The absence of alternating between cooling and heating in real time means that a heat pump design is appropriate for this present invention. The preferred heat pump design is a self-contained air-cooled heat pump using a scroll type compressor whose spent air is ducted outside of the controlled environment of a pressroom. Alternatively, a remote roof-mounted air-cooled condenser unit may be used. In a cooling mode, this preferred "scroll" heat pump design delivers compressed refrigerant to an air cooled condenser and then proceeds to a stainless steel plate heat exchanger which acts as a refrigerant evaporator and a means to cool the coolant circulating to the rotary press of this present invention. Heat from this coolant is removed at this heat exchanger by continuously circulating approximately 15% of the total coolant flow issued from the circulation pump through this plate heat exchanger in a closed flow loop to the reservoir. The balance of the total coolant flow from the circulating pump is the coolant supplied to the rotary press. In the heating mode, the refrigerant gas flow cycle is reversed such that the hot refrigerant issued from the scroll compressor heats the coolant for the rotary machine at the heat exchanger. Then the refrigerant is reheated at the condenser unit using the air as a source of heat before again being re-pressurized at the scroll pump. In this way, the coolant flow to the rotary machine is cooled or heated as required and made available for the ink vibrator rollers, printing plate cylinders, fountain solution recirculator, coating material and the infrared/ultraviolet lamp dryers coolant system. However, this preferred heat pump design is only practical when the application of this present invention does not include fountain solution dryers and coating material temperature control since these do not require heating at all. In such cases, the reverse refrigerant gas flow is removed to result in a standard mechanical air cooled refrigeration system. Whether the central refrigeration system is a heat pump or a standard mechanical refrigeration unit, the preferred embodiment of this present invention includes a means to automatically adjust and balance the cooling load to the press heat load in real time. This present invention achieves this automated cooling adjustment using a central process unit (CPU) coupled with a DC driven electrical moduling valve in a bypass line in the hot gas refrigerant circuit so that an appropriate quantity of refrigerant gas by-passes the air condenser unit to reduce the BTU/HR of cooling load being generated at any instant. Remember that the amount of cooling required at any instant at a given printing press unit is different from the other press units at any press speed since the heat load generated at each depends on mechanical friction heat and the actual ink coverage at each press unit. A larger quantity of ink provides more cooling effect since ink itself is a process coolant. However, a larger quantity of ink at high press speeds generates more shearing heat than lower quantities. Also, the cooling load requirement depends on the press speed in real-time since the heat load increases exponentially with speed. In the first seven aspects of the present invention, adequate heating/cooling capacity is designed into the temperature control system to handle the extreme needs of the printing press in question. As an example, the cooling required for a Multi-Zone ink vibrator roller/dampening solution multi-zone system of this present invention, is a 10–15 ton system (120,000 BRU/HR) for a typical 8-unit sheet-fed press of 40-inch width running at 12,000 to 15,000 copies per hour. For each press unit, the cooling/heating load required at any instant depends on the actual press speeds, the ink type, the actual fluid coverages (ink, dampening solution, coating and drying), press unit design, wear and adjustments. Consequently, there is no possible way to calculate the heat load being generated at the press unit at any instant yet it is important to balance the cooling being delivered to match the heat load being generated to provide a narrow range of process temperature fluctuations in real-time. Therefore, the preferred embodiment of this present invention includes a hot refrigerant gas bypass valve to reduce cooling loads to match instances where the press heat load is lower than the design capacity of the heat pump system. This matching cooling to heat loads is important since it prevents excess cooling loads when the heat loads are lower and this prevents process temperature ranges from being wider than ±1.8° F. Also this hot gas bypass system avoids fatal short cycling of the scroll compressor. As an example, assume the central refrigeration system utilized in an application was a 10-ton capacity capable of removing 120,000 BTU/HR of heat from the rotary machine. This refrigeration system is designed to operate efficiently and dependably during press run periods where the cooling requirements of the rotary machine is 60,000 to 120,000 BTU/HR. However, when a press unit only requires 10–20% or less cooling than the cooling power design (i.e. 12,000 or 24,000 BTU/HR of cooling for a whole process temperature system designed at 120,000 BTU/HR) the 10-ton refrigeration system is vastly oversized. This oversizing results in too powerful cooling during low heat load periods causing fatal short cycling of the scroll compressor of the process temperature control system. More importantly, this excessive cooling situation increases the range of process temperatures. Therefore, the preferred embodiment of this present invention includes a hot gas bypass refrigerant electrical moduling valve coupled to a CPU programmed to control the cooling load generated in real-time. To achieve this automated control, this present invention focuses on the coolant temperature in the actual coolant reservoir temperature (T) in reference to its pre-set temperature (S.T.). When T increases in real-time, this means that the heat load has increased which necessitates more cooling from the refrigeration system. Accordingly, the refrigerate bypass solenoid valve closes proportionally. Similarly, if T decreases, this means that there is too much cooling power and the refrigerant bypass solenoid valve opens proportionally. The preferred software control program is based on the following formula that:

H.G.M.B. openness = (T − SP + 1)* 50% D

Where T = Coolant Temperature

S.P. = Coolant Set temperature (desired coolant temperature to be delivered to the rotary machine and/or the desired coolant reservoir's temperature)

D = Temperature Differential

When H.G. = 100% closed; when H.G. = 0% or negative values = 0% closed (100% open)

Assume that D is set at 2° and SP is set at 65° and T is actually 70° this calls for maximum cooling. Accordingly, the formula calls for 175% closed (100% closed) and issues 10 VDC to the H.G.bypass valve. If T then reduces to 67°, maximum cooling is still required and formula calls for 100% closure and still generates 10 VDC. When T reduces to 66° F., 50% closure is required and 5.0 VDC is issued. When T reduces to 64° F. or less, minimum cooling is required and zero percent closure (100% open) happens and 0 VDC is issued to the H.G.bypass valve. If it is desired to have more rapid movement of the H.G.bypass valve, that is, more rapid charges to the VDC issued in real-time, the D valve of 2 can be reduced at the expense of more frequent compressor recycling and short cycles. Take note that since the infrared sensor cannot read more accurately than 1° F., lowering D to 1° may result in needless compressor recycling without any meaningful added value being actually received in the balancing of cooling to heat loads.

To this point, the many aspects of this invention deals with a host of process temperature applications, each to provide significant improvement befitting the needs of modern day printing press speeds. Increased printing press speeds also require enhanced press operator skills. Since copies are currently generated at speeds up to twenty-five per second, even the most skilled press operator cannot react quickly enough since he or she must necessarily usually review the quality of printed copies to ascertain their degree of acceptability. Reasonably, he or she can only make adjustments to correct future copies and this assumes that the adjustments contemplated were appropriate. Given this reality, a first rate process temperature control system must be highly automated such that the control system operates as quickly and transparently as possible to the press operator. In fact, the strength of this present invention is to incrementally correct process temperature drifts so that the print quality deterioration caused by temperature drifts no longer exist for the operator to witness in his completed copies.

Accordingly, the eleventh aspect of this present invention is a PLC controlled system coupled with a Touch Screen monitor. This Touch Screen allows the press operator to set the required process temperatures for a plurality of press units using his or her experience. This electronic interface permits the press operators to oversee the integrity of the dynamic printing process temperature control system since all actual coolant flow adjustments are automatic, instantaneous and transparent to him. The press operator merely sets the desired process temperatures, verifies that these are being achieved and/or resets those that will improve the quantity of the printing production. Further, given the fundamental importance of the process temperature control of this present invention, any equipment malfunction must be quickly known and presented in a most simple manner for quick resolution. Accordingly, this aspect of the present invention includes an electronic diagnostic system, which identifies emerging equipment problems and graphically depicts the corrective measures required. This elaborate diagnostic system detects many minor cooling/heating problems that will interfere with the efficiency of process temperature control system and the integrity of the whole printing process. If left unidentified and/or unattended, this will lead to press downtime.

In this regard, a further twelfth aspect of this present invention is to provide essential control over the very important solenoid valves by using thermocouples attached to their body to monitor their actual temperature in real-time. When a solenoid is activated (energized), it heats up according to its own individual temperature fingerprint whether it is a normally open or closed type. If a solenoid valve fails to open or close for mechanical reasons upon activation, its body will be at a different temperature, than if operated correctly. As an example, if a solenoid is activated to close (normally opened) but does not, it will remain cooler more than if it had closed correctly. If this occurs, the coolant would still flow and cool the activated coil of the solenoid valve resulting in a lower solenoid temperature than if it had closed properly. Therefore, the use of a thermocouple on the body of solenoid valve identifies the integrity of operation of each solenoid. When these solenoid thermocouples are coupled to a PLC/Touch Screen, this aspect of the present invention provides important diagnostic control to monitor the integrity of each solenoid and by inference, the integrity of the process temperature control system itself. To further reduce press downtime, all diagnostic and operating data may be transmitted by telephone modem for remote professional equipment evaluation and problem solving or simply as an equipment audit means towards better preventive maintenance.

BRIEF DESCRIPTION OF THE DRAWINGS

Having thus generally described the invention, reference will be made to the accompanying drawings illustrating embodiments thereof, in which:

FIG. 11.1 is a schematic diagram illustrating the utility in using a programmable logic controller (PLC) and a color touch screen for a rapid response process temperature control systems and for appropriate graphic diagnostic;

FIG. 11.2 illustrates. Also the main screen of the color touch monitor for a seven unit press;

FIG. 11.3 illustrates the set-up screen of the color touch monitor;

FIG. 11.4 illustrates the infrared temperature calibration screen of; and

FIGS. 11.5 and 11.6 are graphic diagnostic representations of the alarm status with depiction of diagnostic probable causes.

DESCRIPTION OF THE PREFERRED EMBODIMENTS

Figure 1:
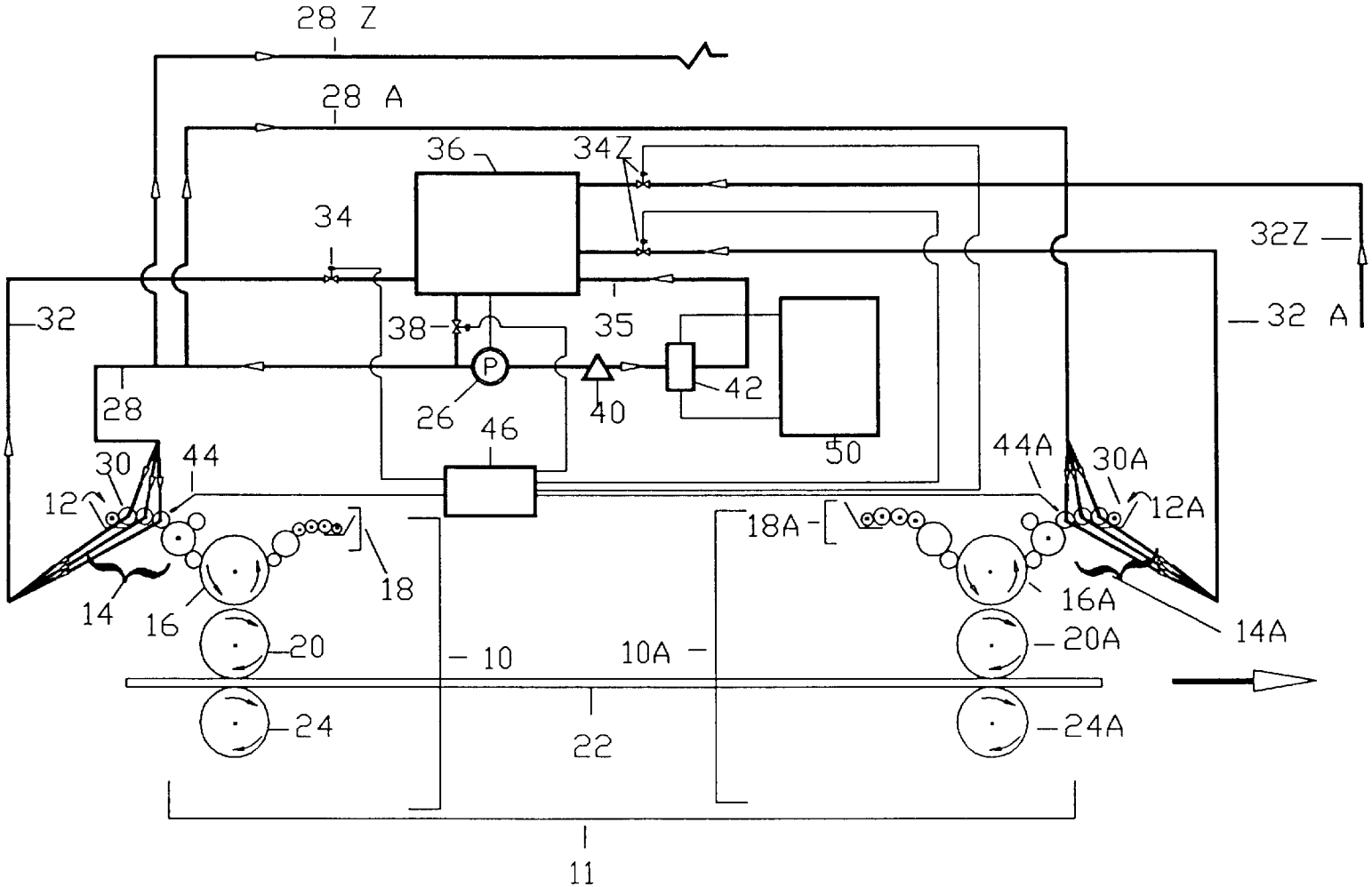
FIG. 1 is a schematic diagram of a plurality of printing press units illustrating a coolant flow path to the ink vibrator roller.

Referring to the drawings in greater detail and by reference characters thereto, the schematic diagram of FIG. 1 shows a side view of two units of a typical rotary press unit 10 and a plurality of press units represented by press unit 10 and 10*a* of press 11. In terms of this typical rotary press design, press unit 10 includes an ink reservoir 12 from which ink is transmitted through an ink train of a plurality of rollers 14 to generate an ink film to a printing plate mounted on plate cylinder 16. In the circumstances of the conventional lithographic process, water based lithography, a film of water based dampening solution is first applied through the dampening solution roller train 18 to the printing plate fixed on the plate cylinder 16. The ink film from roller assembly 14 is applied immediately on top of the dampening solution film on the printing plate of the plate cylinder 16. The dampening solution roller train 18 and ink roller train 14 each has the means to adjust the respective quality and quantity of the film of each fluid, dampening solution and ink. In waterless lithography, the dampening solution roller train 18 does not exist, or it is disengaged, so that no dampening solution is transmitted to the printing plate on plate cylinder 16.

In water based lithography, it is essential to obtain and maintain the optimum film of dampening solution and ink on the plate cylinder 16. The primary printing trade skill is to find and to maintain a proper ink/water balance in real time throughout a printing run. This is achieved, in part, by the nipping adjustments of roller train 14 and 18 according to the film characteristic of the ink and dampening solution in relationship to the press operator's visual judgement of the quality of the copies just produced. Both the ink and dampening solution films are subject to process temperature changes in real-time. The blanket on the blanket cylinder 20 transfers its ink dot array from the plate cylinder 16 to the substrate 22, which is held in contact with the blanket by the temperature sensitive and adjustable nipping pressure of the impression cylinder 24. The substrate 22, usually is a sheet of paper or the unravelings from a roll of paper, proceeds to a plurality of similar printing units 10 A to Z (only some of the units being shown here and in the other figures), where ink dots are applied to the substrate 22 adjacent to one another, one process color per printing unit. This ultimately results in a full visual image of the original copy being printed.

All the rollers of printing press unit 10, and this for a plurality of press units, are typically driven on one side of the press (called the gear side) where the mechanical friction heat generated is much greater than the other side (called the bearing side). This differential in heat loads across each printing unit causes detrimental process temperature differences. Also, the friction heat loads generated at each press unit machine varies with press speeds and ink shearing. Furthermore, the heat load varies from one press unit to another at the same speed. These real-time variable heat loads themselves alter the mechanical adjustments of each unit of the printing press 11 in an inconsistent, continuous and complex manner. Also, the resulting process temperature changes in real-time coupled with the chemical characteristics of the ink and/or dampening solution alter the size and shape of each ink dot. All these real-time factors, and others, cause print quality drifts which, in turn, requires frequent press unit adjustments throughout a printing run to attempt to limit the range of these print quality drifts. Therefore, rigid process temperature control in real-time is an essential element for quality printing production at today's high press speed. The quality process temperature control system of this invention reduces print quality drifts, reduces the frequency of press adjustments, yielding better overall print quality and reduces wasted copies.

To deal with the rapid and variable press heat loads in the forward and transverse directions of a press 11 as a print run progresses, it is required to utilize a process temperature control system that quickly deals with a multiple assortment of heat load changes to limit the range of process temperatures in real-time. The many aspects of this present invention are dedicated to limiting process temperature ranges in real-time to ±1.8° F.(±1° C.).

Figure 10:
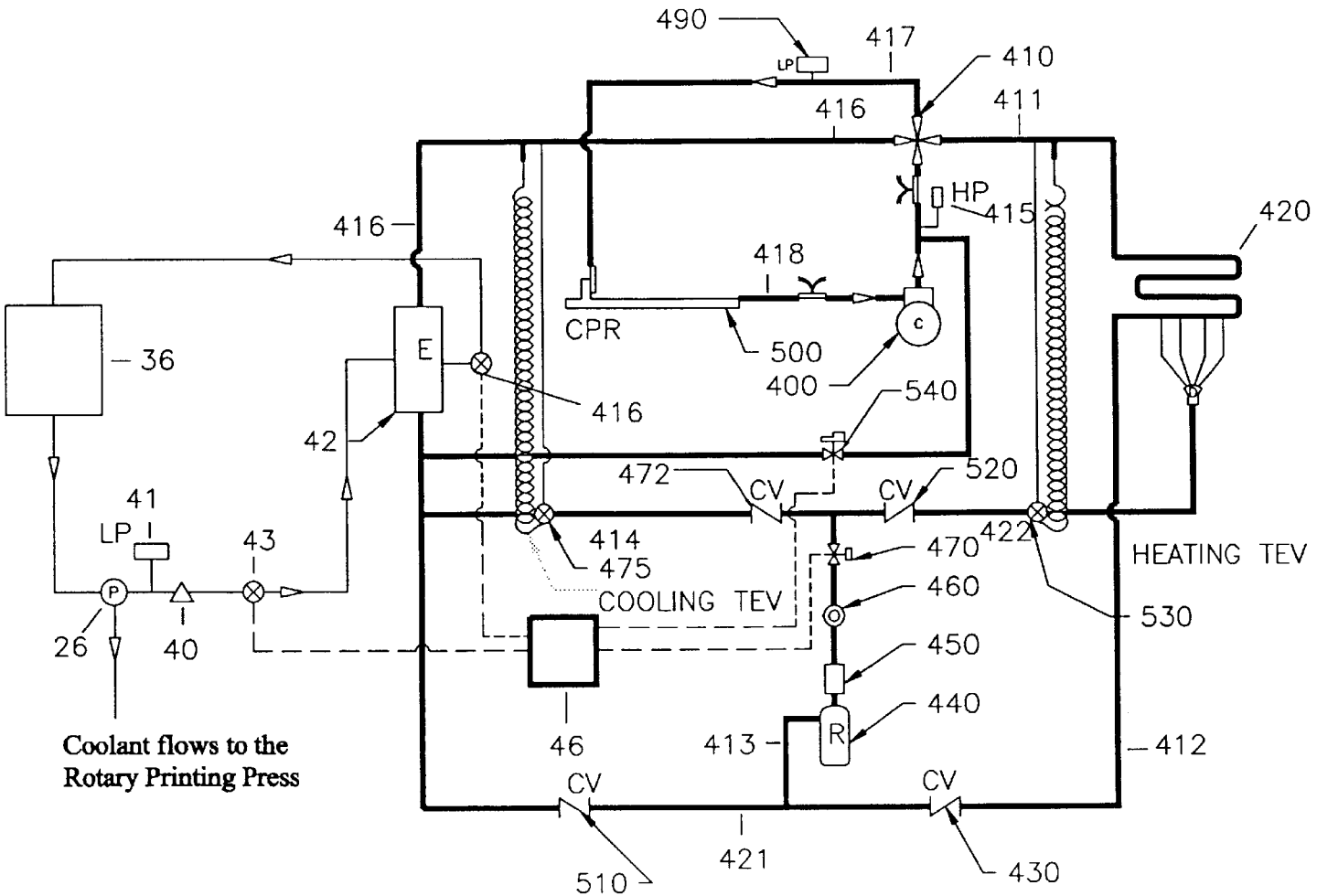
FIG. 10 is a schematic diagram of the heat pump design preferred for the various aspects of the present invention.

In the first aspect of the present invention, illustrated in FIG. 1, a plurality of press units 10, a to z, of press 11 are supplied with process temperature control using a central high volume coolant circulation rotary pump 26 in continuous operation, usually a water based coolant with appropriate additives, in a closed loop manner via conduit 28, a to z, to the printing unit 10, a to z respectively. The coolant from conduit 28 flows through rotary unions 30, one per ink vibrator roller, to the hollow ink vibrator rollers 14, and then is discharged through conduit 32 to a "normally open" solenoid valve 34 which, in turn, discharges to reservoir 36. Alternatively, the coolant flow in conduit 28 bypasses press unit 10 through a "normally closed" solenoid valve 38 discharging directly to the reservoir 36 when solenoid valve 34 is closed. This prevents coolant pressure dead-heading at pump 26. From reservoir 36, the coolant is also conduited by the circulation pump 26 to an inline flow regulator 40 delivering about 15% of total coolant flow issued from pump 26 to a heat exchanger 42 and then discharged on a continuous uninterrupted manner to the reservoir 36 via conduit 35. This controlled coolant flow loop is cooled or heated in the preferred embodiment of this present invention by heat pump 50 which is more fully described in the tenth aspect that follows as illustrated by FIG. 10. The approximate 85% balance of coolant flow is delivered to the ink vibrator roller train 14 of press unit 10 as described above and to a plurality of press units 10, a to z of press 11. A non-contact temperature sensor 44 at the ink vibrator roller train 14 directly reads the temperature of process ink color of press unit 10 in real time and is coupled to a temperature controller 46, which in turn, operates solenoid valves 34 based on the set temperature input into the temperature controller 46 by the press operator. In a preferred embodiment of this invention, the temperature controller 46 is a programmable logic controller (PLC) coupled with a touch screen monitor for the efficient and ease of control for a plurality of printing press unit 10 a to z where the normally opened solenoid valves 34, a to z, one per press unit, is coupled to a corresponding temperature sensor, 44 a to z. In this embodiment, the press operator inputs his desired ink process temperature for each unit of press (set temperature) and the rigid operation of process temperature control system of this present invention is automated and transparent to him or her. In a preferred embodiment, the normally closed solenoid valve 38, one for a plurality of press units, is controlled to open when only 30% or less of solenoid valves 34, A to Z, are in the open position. This first aspect of the present invention is called a Multi-Zone Ink Vibrator Roller Process Temperature Control System.

Figure 2:
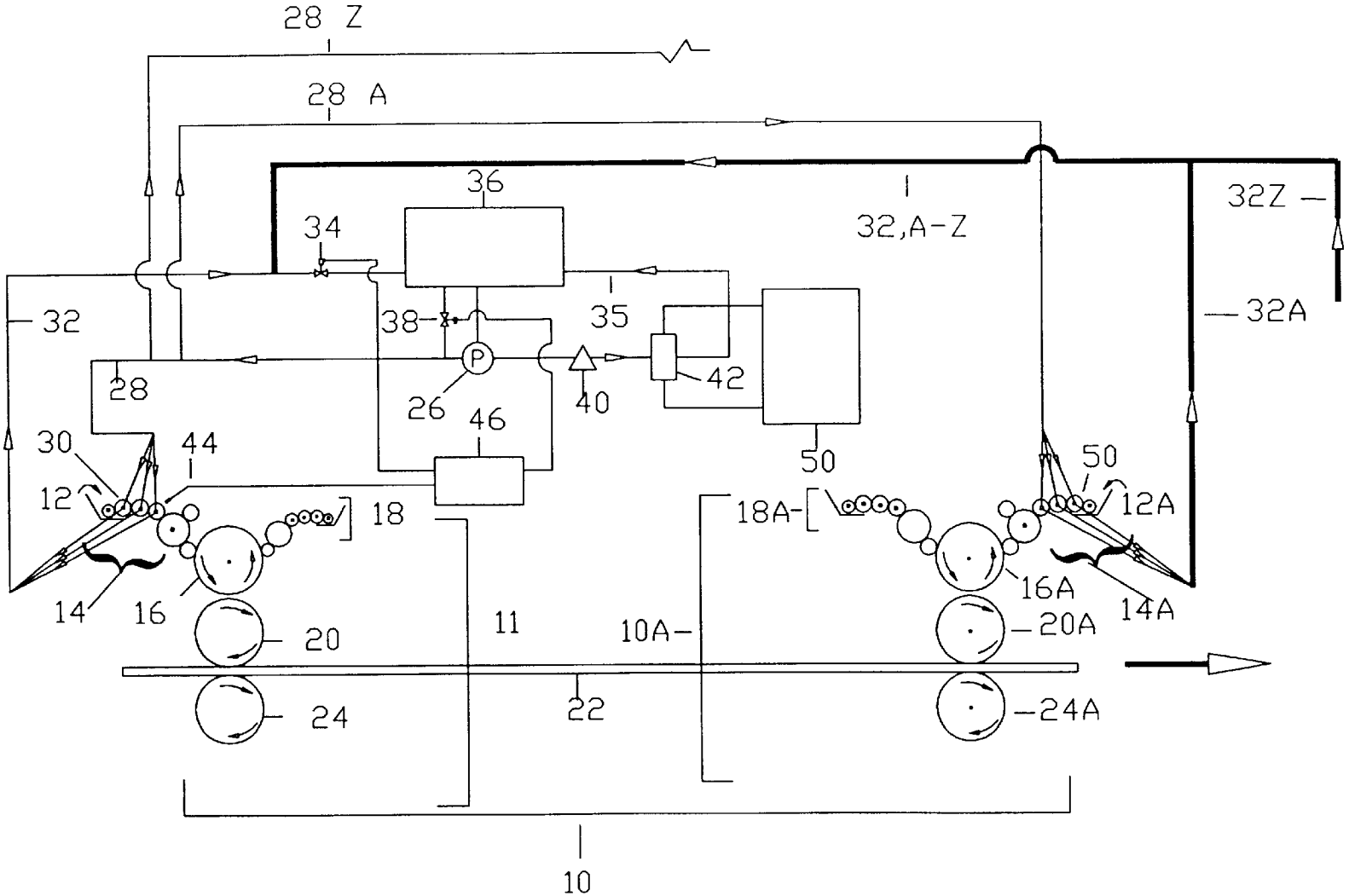
FIG. 2 is a schematic diagram of a plurality of printing units illustrating an external coolant flow path to the ink vibrator roller train.

In the second aspect of the present invention, illustrated in FIG. 2, a plurality of press units 10, a to z, are supplied with process temperature control using only one infra-red sensor 44 at one selected press unit, and one main solenoid valve 34. In this second aspect, the external cooling returns to solenoid valve 34 from a plurality of press units via conduit 32, a to z, and joins conduit 32 to pass through normally open solenoid valve 34 before returning to reservoir 36. In this second aspect, only one press unit is selected on which an infrared sensor 44 is mounted since the friction heat load generated by this unit may be sufficiently representative of all other press units 10, a to z, at all press speeds. However, this control of process temperatures, called an Omni-Zone Ink Vibrator Roller Process Temperature Control System, does not account for the individual heat load patterns of each press unit 10, a to z, with respect to press speeds due to the differences in mechanical design tolerances, specific adjustments and wear of each press unit. Also, this aspect does not take account for the differences in ink shearing heat generated at each unit of press at high press speeds because this heat source is a function of the specific amount, and type, of ink being applied at each unit of press at a given high press speed. Nevertheless, this second aspect of the present invention provided precise ink temperature control to ±1.8° F. at the selected press unit and vastly improved process temperature control at the other press units than previously existed at significant purchase price savings in comparison to a multi-zone temperature control system of the first aspect of the present invention. Since many print jobs can tolerate a wider range of quality drift in the copies produced, this second aspect of this invention will be favorably received.

Figure 3:
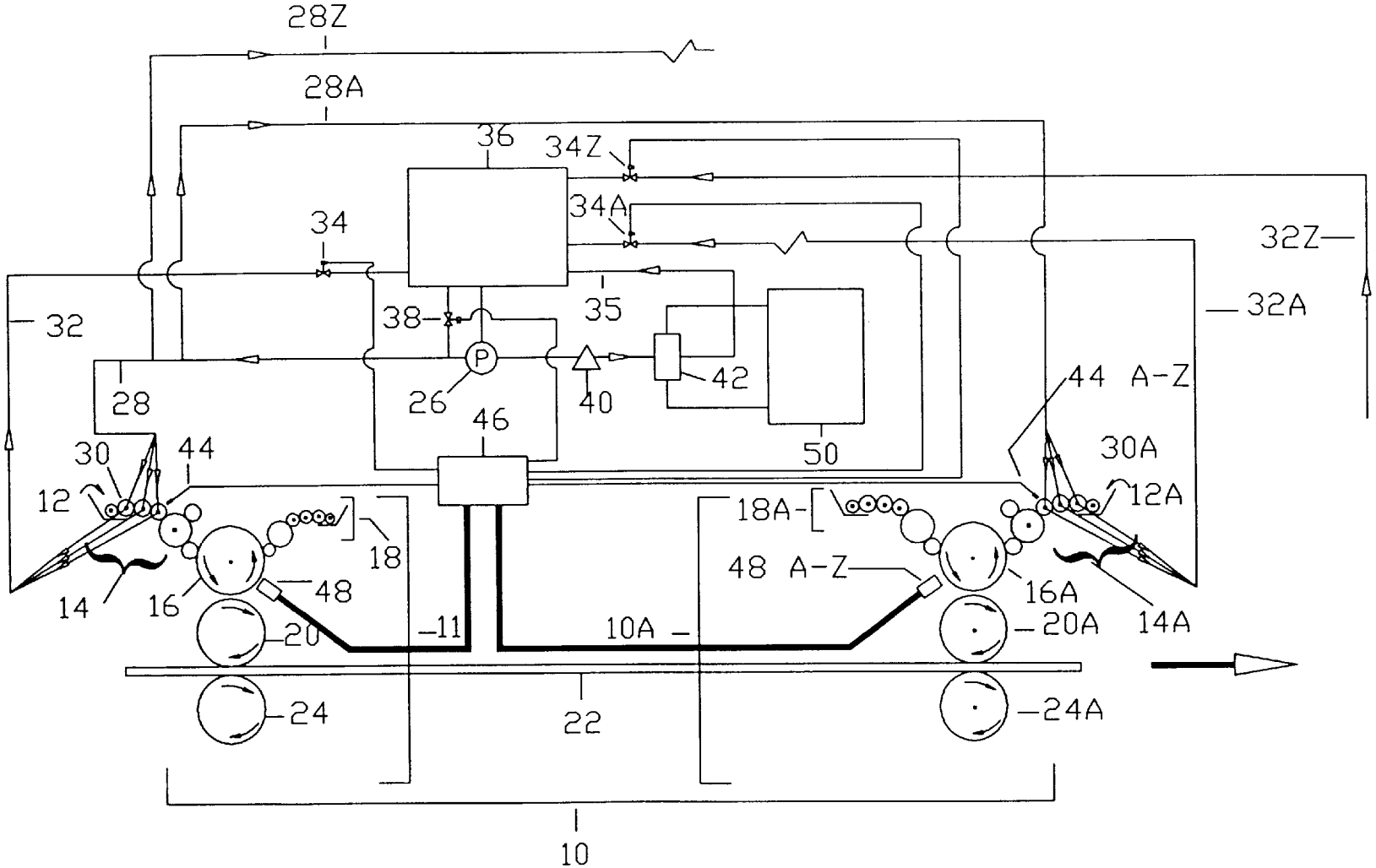
FIG. 3 is a schematic diagram of a plurality of printing press units illustrating an external coolant path to the ink vibrator roller in conjunction with a multi-zone ink vibrator roller temperature control system.

In a third aspect of the present invention, illustrated in FIG. 3, a plate cylinder temperature sensor 48, or a plurality of them (48, a to z), is coupled to the temperature controller 46 is added to the first aspect of this present invention as shown in dark relief. This plate cylinder temperature monitoring may be added to the second aspect of the present invention as well. In this third aspect, the desired temperature range of plate cylinder 16 is manually set. When the temperature at the plate cylinder 16 is outside of a pre-set range, the controller 46 signals awareness by an alarm to result in a manual re-setting of the temperature setting at temperature sensor 44 to increase or decrease coolant flowrate in real-time at the ink vibrator roller train 14 to increase or decrease the ink temperature at the plate cylinder 16, respectively. In this aspect, as well as the other aspect of this present invention, the ink itself is a direct coolant fluid to cool the plate cylinder 16 for press designs where the plate cylinder rollers are not hollow to receive coolant directly. This third aspect of this present invention, a Plate Cylinder Roller Temperature Monitoring System, may be incorporated into the first or second aspect of this invention.

Figure 4A:
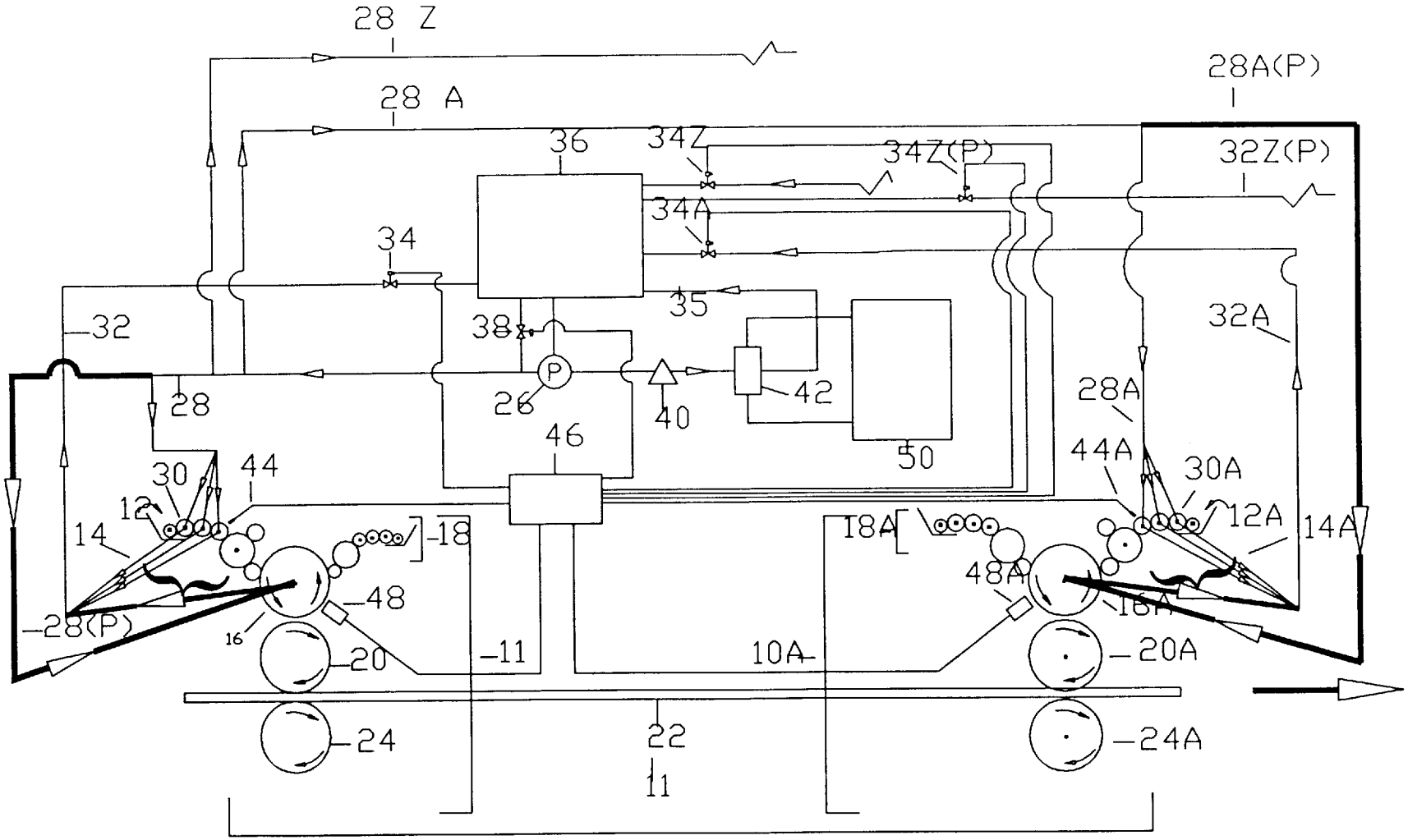
FIG. 4A is a schematic diagram of a plurality of printing press units having a Multi-Zone printing plate temperature control system.
Figure 4B:
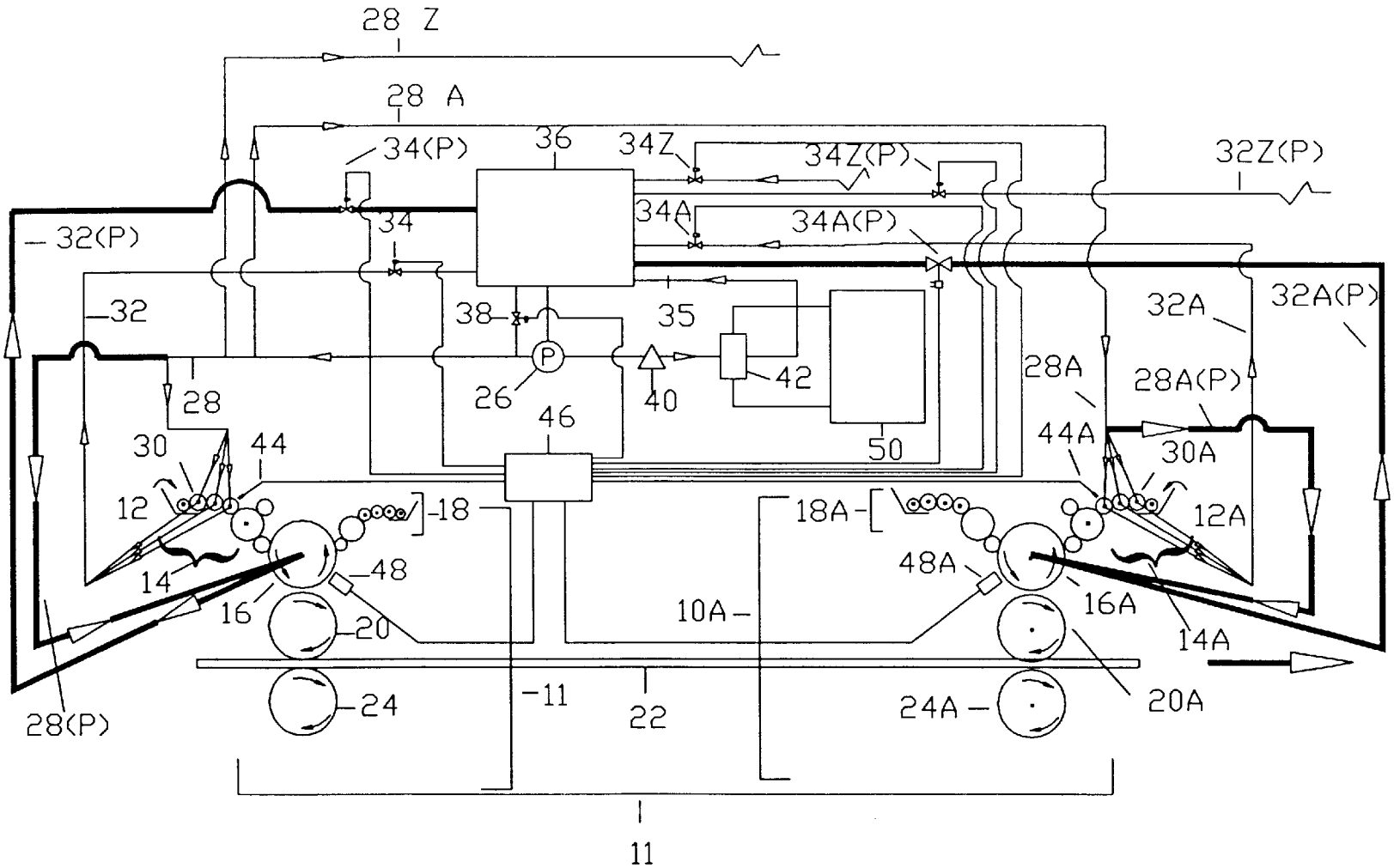
FIG. 4B is a schematic diagram of a variation of the Multi-Zone system of FIG. 4A.

In a fourth aspect of the present invention, illustrated in FIG. 4*a,* process temperature control is also provided to the plate cylinder rollers, which are designed to receive coolant in addition to the ink vibrator roller cooling/heating of the first three aspects. The heating/cooling coolant flow through conduit 28 from pump 26 is split to supply plate cylinder 16 as well as the ink vibrator roller train 14, and this for a plurality of plate cylinders 16, a to z, such that the coolant discharges from plate cylinder 16, a to z into conduit 32, a to z, to return the coolant through the main solenoid valve 34, a to z, respectively, and then to reservoir 36. FIGS. 4*a* and 4*b* illustrates a multi-zone plate cylinder system as shown in dark relief in conjunction with a Multi-Zone Ink Vibrator Roller Train Process Temperature system of the first aspect of this invention. Alternatively, as shown in FIG. 4*b,* an independent plate cylinder multi-zone system, coolant flow circulation path is created along an independent conduit 28 (P), a to z, to the plate cylinder roller 16, a to z. The coolant discharge from plate cylinder 16, a to z, returns to reservoir 36 on conduit 32 (P), a to z, through solenoid valve 34 (P), a to z, respectively. Again, FIG. 4B shows this independent multi-zone plate cylinder temperature control system in conjunction with a Multi-Zone Ink Vibrator Roller Train Process Temperature control System, of the first aspect of this present invention (FIG. 1). Similarly, this combined system could be an Omni-zone plate cylinder system running in conjunction with the second aspect (FIG. 2) of this present invention. For simplicity, the same numbering was used as in FIGS. 4*a* & 4*b* but for the addition of the suffix "(P)" to designate the plate cylinder temperature control system flow circuit. In this fourth aspect of the present invention, the plate cylinder roller 16, a to z, is subject to direct and independent process temperature control in precisely the same manner as the ink vibrator roller train process temperature control system as described in the preferred embodiment of the first and second aspect of this invention (FIGS. 1 & 2).

Figure 5:
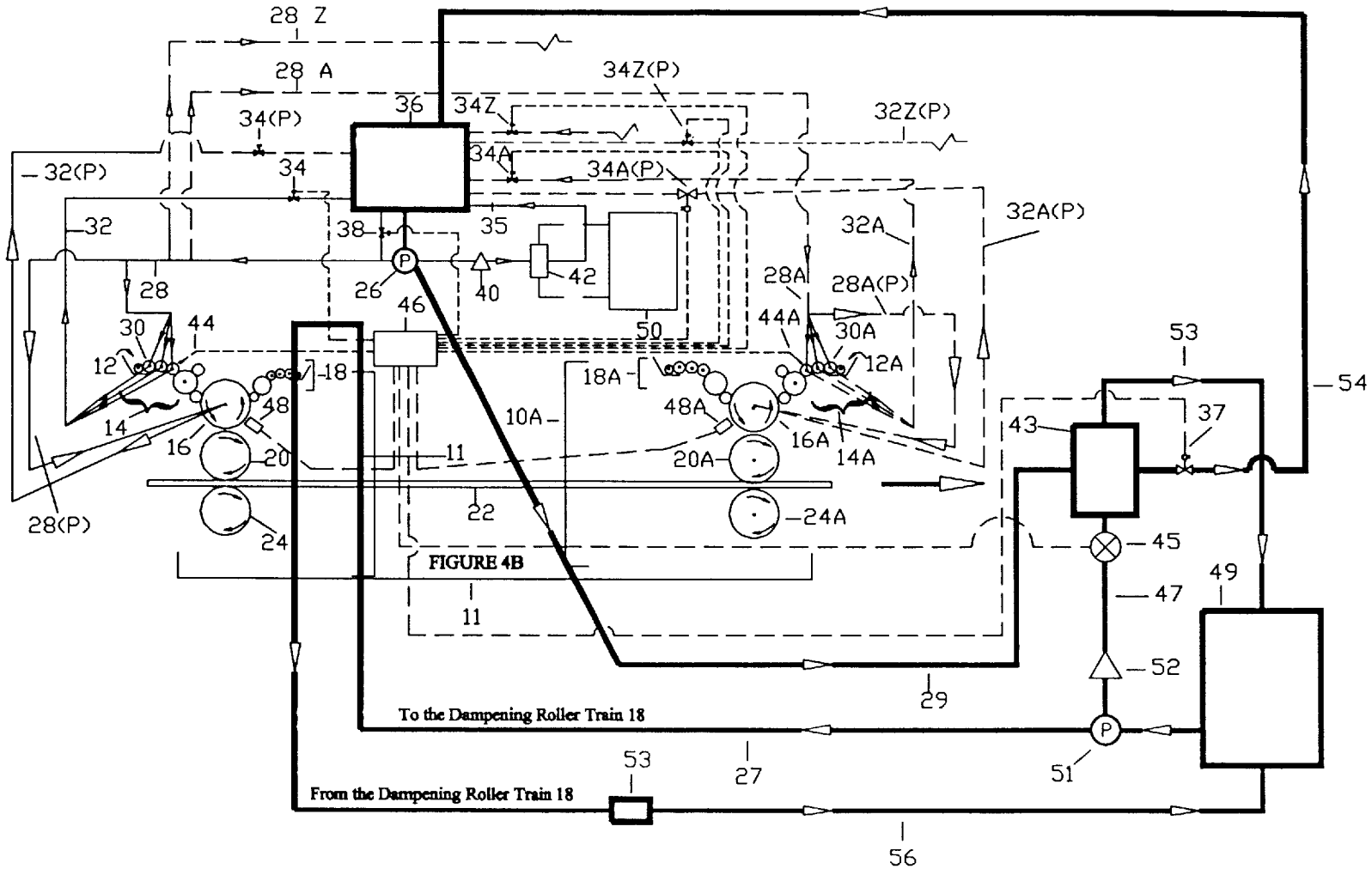
FIG. 5 is a schematic diagram of a variation of the embodiment of FIG. 4B.

In the fifth aspect of the present invention, illustrated in FIG. 5, describes a Multi-Zone process temperature control for the dampening solution used in water based lithographic printing. The ink vibrator roller and printing plate multi-zone process temperature control system illustrated in FIG. 4*b* was used in FIG. 5 and the dampening solution components and its flow circuits are shown in dark relief The dampening roller train 18 is supplied with dampening solution from a recirculating system dedicated to each press unit 10, a to z, of press 11 or one for a plurality of press units 10, a to z. In FIG. 5, the dampening solution recirculator system is shown for press unit 10 only. However, a single dampening solution plate temperature control system can supply all press units 10, a to z or there may be one such control system for each press unit. A dampening recirculation system typically includes mechanical refrigeration to cool the dampening solution being issued to the press at some set temperature (i.e., 55° F.). These dampening solution recirculator systems are known art. However, no attempt is made in the prior art, to directly use the chilled dampening solution as a coolant for process temperature control. In conjunction with the fourth aspect of this invention shown in FIG. 4B, the dampening solution temperature control system, illustrated in FIG. 5 and shown in dark relief, may be manually or automatically adjusted to control the process temperature at plate cylinder 16 and this for a plurality of plate cylinders 16, a to z, for all types of dampening solution recirculator systems used in the printing process. From pump 26, external coolant is moved on conduit 29 to plate heat exchanger 43 and discharged through solenoid valve 37 on conduit 54 to reservoir 36. This external coolant loop cools the dampening solution entering heat exchanger 43 from the dampening solution pump 51 on conduit 47 and exiting on conduit 53 to the dampening solution reservoir 49 in a continuous loop whose flow rate is controlled by a flow regulator 52 and whose temperature is monitored by thermocouple 45 and controlled by temperature controller 46. This continuous flow loop exists to control the dampening solution in reservoir 49 at some pre-set temperature (i.e. 55° F.). Principally, pump 51 supplies dampening solution to dampening roller train 18 via conduit 27 and the overflow in the pan of dampening roller train 18 returns to reservoir 49 by gravity via conduit 56 which can be made more reliable by the aid of an air operated vacuum pump 53. When infra red sensor 48 at the printing plate cylinder 16 coupled with temperature control 46 calls for more or less cooling of the fountain solution, solenoid valve 37 is automatically opened or closed, respectively, and this for a plurality of press units 10, a to z. Prior art of dampening solution cooling do not attempt to control the dampening solution temperature in real-time relative to the plate cylinder temperatures. If the infrared sensors 48 a to z, are coupled to the temperature control 46, there may be one recirculator system for a plurality of press units 10 a to z or one such system for each press unit 10 a to z.

Figure 6:
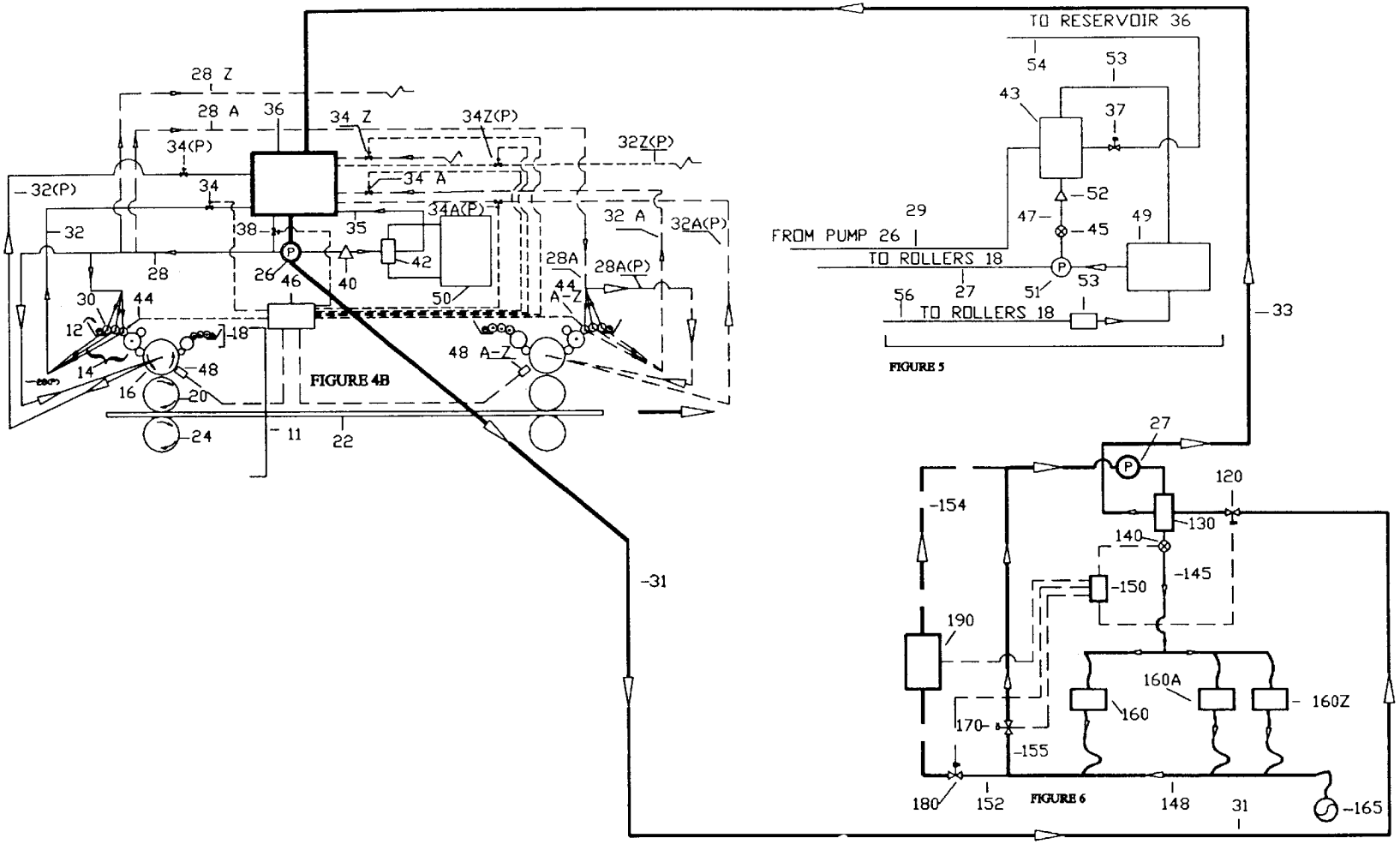
FIG. 6 is a schematic diagram illustrating the process temperature control system shown in FIG. 5 in conjunction with an infrared/ultraviolet printing press dryer coolant system.

The sixth aspect of the present invention, illustrated FIG. 6, is a process temperature control system for infrared or ultra-violet dryer head systems 160 a to z. These dryer heads are commonly used with multi-color printing presses to assist in drying inks on the printed copies. Without dryers, some ink types do not set well enough for copies to be piled, one on the other, without offsetting ink from one copy to the back of the next copy and/or resulting in piled copies cemented together into a solid useless mass. Unfortunately, the dryer heat source disrupts process temperature control. In this embodiment, shown in FIG. 6 in dark relief, in conjunction with fountain solution/multi-zone printing plate/ink vibrator roller train process temperature control system (FIG. 5), the cold coolant from pump 26 is issued in conduit 31 to solenoid valve 120 to heat exchanger 130 and then returned to reservoir 36 on conduit 33. The closed loop infrared or ultra-violet dryer circulation system includes dryer coolant pump 27, a thermocouple 140 in relation to a temperature controller 150 (this could be temperature controller 46) coupled to the solenoid valve 120, dryer heat lamp unit 160, or a plurality of lamp dryers, (one set per press unit), and expansion tank 165. When more cooling is desired to lamp dryers as determined by thermocouple 140 in the dryer coolant flow in conduit 145 issued from the heat exchanger 130, solenoid valve 120 is opened. The dryer coolant then discharges from dryer head 160 a to z on conduit 148 to conduit 155 without the inclusion of solenoid valve 170 or conduit 152 and 154. If additional dryer cooling capacity is required as may be the case for a plurality of lamp dryer heads 160, a to z, one normally closed solenoid valve 170, one normally open solenoid valve 180 and an auxiliary standard glycol ambient air cooled system 190 are the additional equipment required on conduit 152 and 154. In this case, the dryer coolant flowing from the dryers 160, a to z on conduit 148 is prevented by solenoid 170 from passing through conduit 155. Rather, the dryer coolant flows from conduit 148 through solenoid valve 180 on conduit 152 to an ambient air-cooled system 190 (usually outside the pressroom) and then returns to pump 27 on conduit 154 as a closed loop system. Typically, the dryer coolant temperature at thermocouple 140 is maintained at 100° F. to 120° F.

Figures 4B, 5, 7:
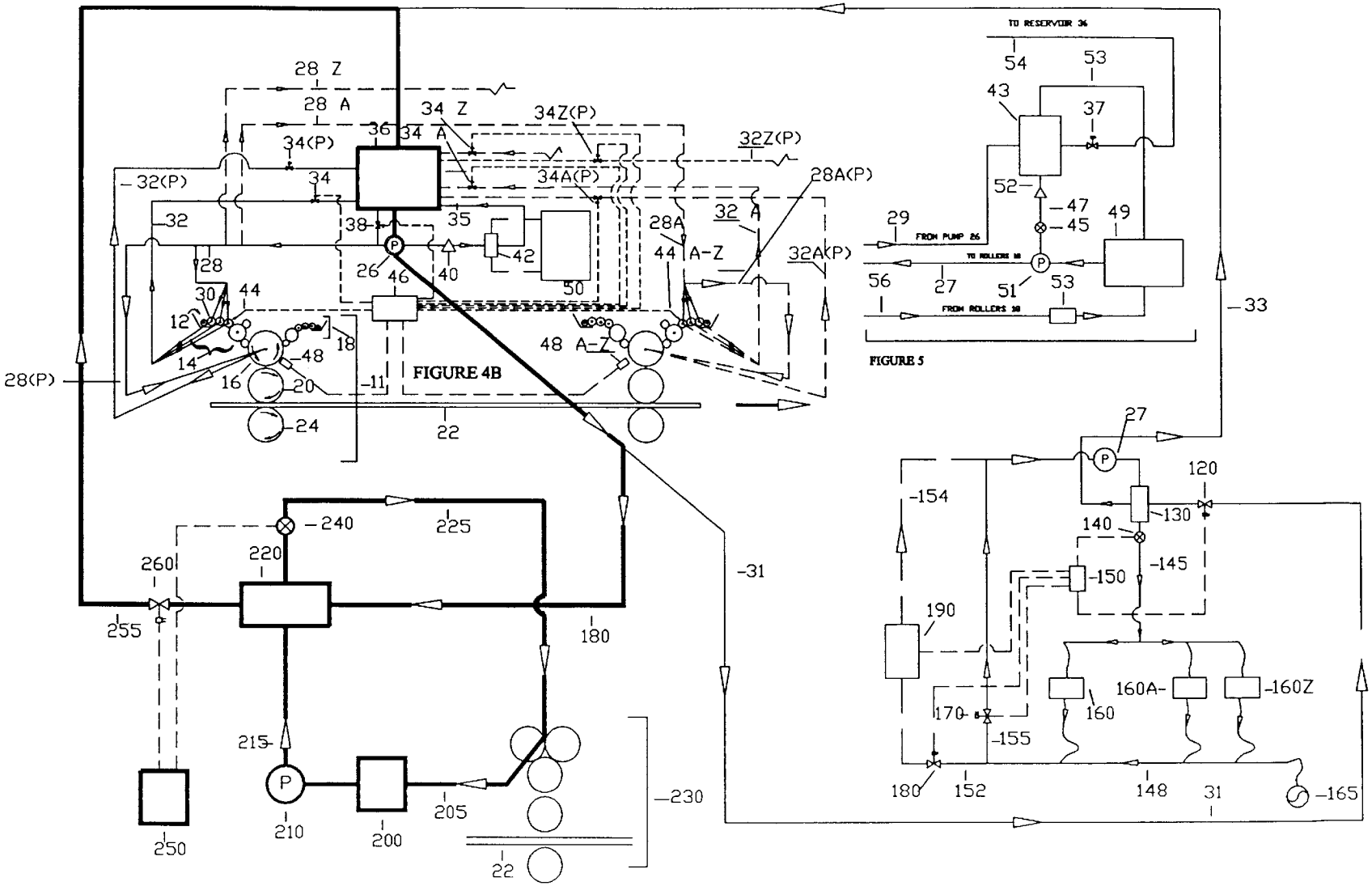
FIG. 7 is a schematic diagram illustrating the process temperature control system shown in FIG. 6 in conjunction with a printing coating unit process temperature control system.

A seventh aspect of the present invention, illustrated in FIG. 7 and shown in dark relief, is a process temperature control system for a fluid coating material application system at coating press unit 230 to coat the substrate 22 after the printing process of press units 10, a to z, of a press 11 is completed. Typically, press-coating fluid is applied as a metered film on the substrate 22 after all ink colors are applied. The coating press unit 230, coating material reservoir 200 and a coating supply pump 210 are known prior art. According to this aspect of the present invention, the coating fluid issued from pump 210 via conduit 215 and passed through plate heat exchanger 220 before being delivered to the press-coating unit 230 via conduit 225. A thermocouple 240 is placed in the coating flow issued from heat exchanger 220 in conduit 225 and coupled to temperature controller 250. Of course, temperature controller 250 may be temperature controller 46 that serves the whole external coolant flow circuit in which pump 26 is the central circulation pump. A coating fluid film is metered by the coating roller train 230 to the substrate 22 and the overflowing coating fluid is returned to the reservoir 200 via conduit 205 by gravity. A solenoid valve 260 in the closed loop external coolant flow circuit from the heat exchanger 220 on conduit 255 is returned to reservoir 36 and then moved by pump 26 to the plate heat exchanger 220 on conduit 180. Typically, the temperature of coating material must be kept within a range of ±2° F. from a specific optimum temperature (i.e. 75° F.) established by the coating chemical manufacturer. Usually, there is no need for heating of coating material. However, if heating is required, it is available by adopting the heating arrangement described in the eight aspect of this invention.

Figure 8:
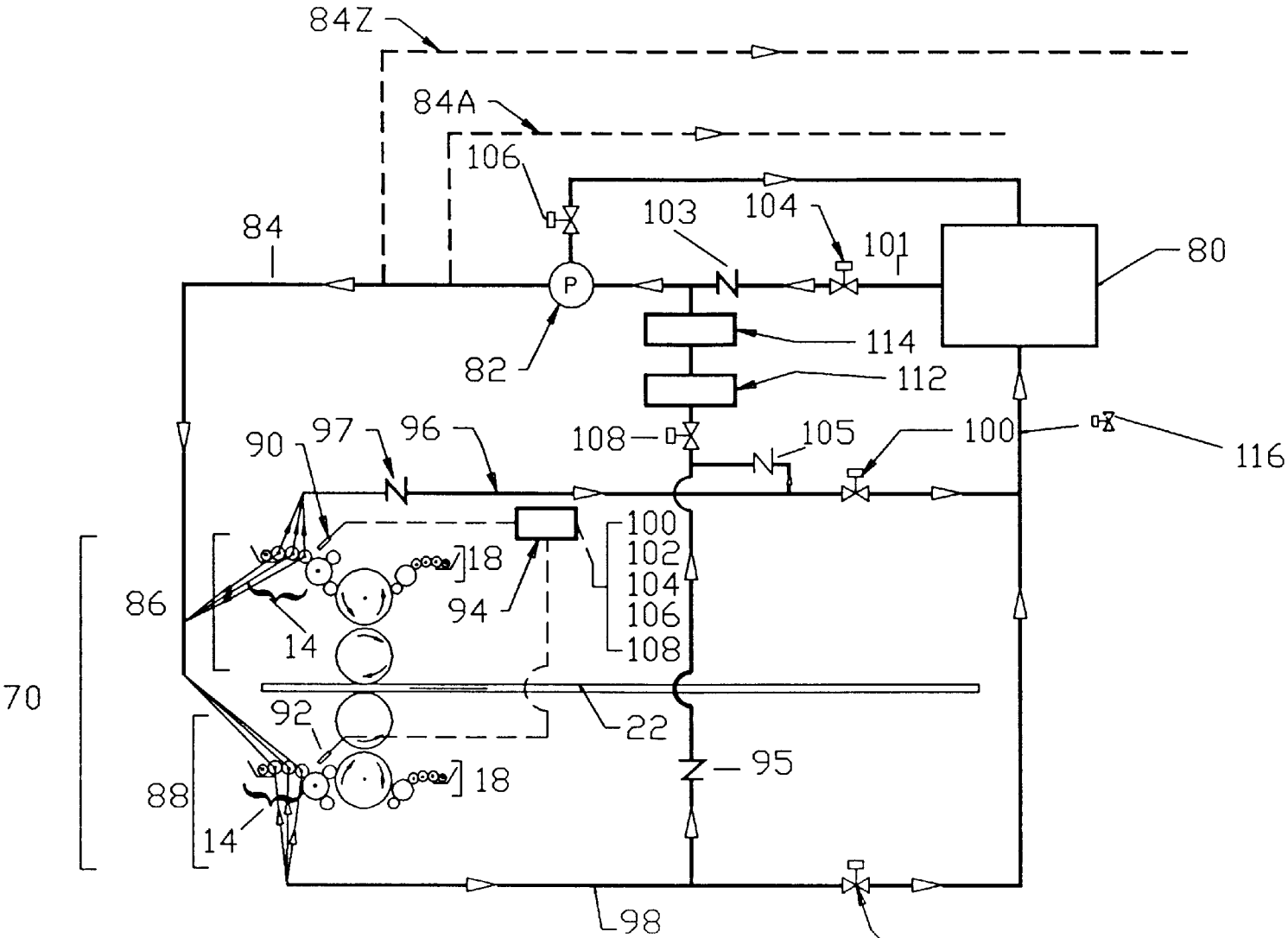
FIG. 8 is a schematic diagram illustrating an external coolant flow path to the ink vibrator roller train.

An eighth aspect of this present invention, illustrated in FIG. 8, is shows a process temperature control system using a pre-existing multiple purpose central chiller system commonly associated with web pressrooms. A web press is a continuous paper feed printing process supplied from rolls of paper. A newspaper press is commonly of this type. Many of the smaller web presses may use a process temperature control system as described in the seven aspects of this invention (more commonly associated with sheetfed pressrooms). Many web presses are so large that their pressrooms are typically equipped with a large central chilling system to handle a multiplicity of their cooling requirements (50 to 200 tons of chilled water). As illustrated in FIG. 8, coolant is pumped from a reservoir 80 of typical central chilling system and boosted through pump 82 to press unit 70, or a plurality of press units 70, a to z via through conduits 101 and 84, a to z. Typically, press unit 70 consists of an upper 86 and lower 88 ink vibrator roller train since web presses are usually perfecting machines where perfecting meaning that one ink color is applied simultaneously on both sides of substrate 22 at each unit of press unit 70 a to z by upper 86, a to z and lower 88, a to z, ink vibrator roller train. The coolant enters the ink vibrator roller train of upper 86 and lower 88 via rotary unions, (typically three per ink vibrator roller set 86 and 88). The non contact ink temperature sensor 90 and 92 monitors the ink temperatures at roller set 86 and 88 and coupled to the temperature controller 94 and solenoid valve 100 and 102, respectively. The external coolant flow from ink vibrator roller train 86 and 88 exits on conduit 96 and 98, respectively, and returns to the reservoir 80. When cooling is not required at ink vibrator roller train 86 and/or 88, solenoid valve 100 and/or 102 are closed by temperature controller 94 and solenoid valve 106 is opened to create a bypass flow circuit so that continuous pumping can exist without pressure deadheading pump 82. In addition, a check valve 103 prevents a reverse flow on conduit 101 to the reservoir 80 during heating periods. When heating is desired (usually only needed at the press start up after the press has been idle for many hours), a heating mode is included in this present invention. In such cases, solenoid valves 100, 102 and 104 are closed and solenoid valve 108 is opened to provide a closed loop heating system comprising of reservoir 114, electric probe heater 112, pump 82, upper 86 and lower 86 ink vibrator roller trains of press unit 70 and this for a plurality of press units. In the heating mode, non-contact temperature sensors 90 and 92 coupled with the temperature controller 94 controls the electrical probe heater 112. In a preferred embodiment of this aspect of the present invention, a plurality of press units may be served by splitting the coolant conduit 84, a to z, one per press unit such that each other press unit is temperature controlled as is press unit 70 using its own IR sensors, 90 and 92, a to z, main solenoid valves, 100/102, a to z, and discharge conduits 96/98, a to z. Additionally, check valves 95, 97, 99, 103 and 105 exist to prevent reverse flows. This aspect of the present invention is a multi-zone web press ink vibrator roller train process temperature control system comparable to the first aspect of this present invention. In an alternative arrangement, this aspect of the present invention may be modified to operate as an Omni-Zone system, as previously described, serving a plurality of press units by following the same methodology set forth in the second aspect of this present invention (FIG. 2). For omni-zone cooling mode, solenoid valves 100 and 102, IR sensor 90 and 92 are not used on press unit 70. Instead, one IR sensor on any one unit of a plurality of press units 70, a to z and one main solenoid valve 116 is added to replace solenoid valve 100/102, a to z. In an omni-zone system, solenoid valve 116 is closed when bypass solenoid valve 106 is open and vice versa. In the circumstance of the multi-zone web temperature control system bypass, solenoid valve 108 opens when only 30% or less of main solenoid valves 100 a to z and 102, a to z are open. Obviously, this eighth aspect of the present invention using a pre-existing central cooling system can be utilized to provide temperature control as described previously in the other seven aspects of this present invention.

Figure 9:
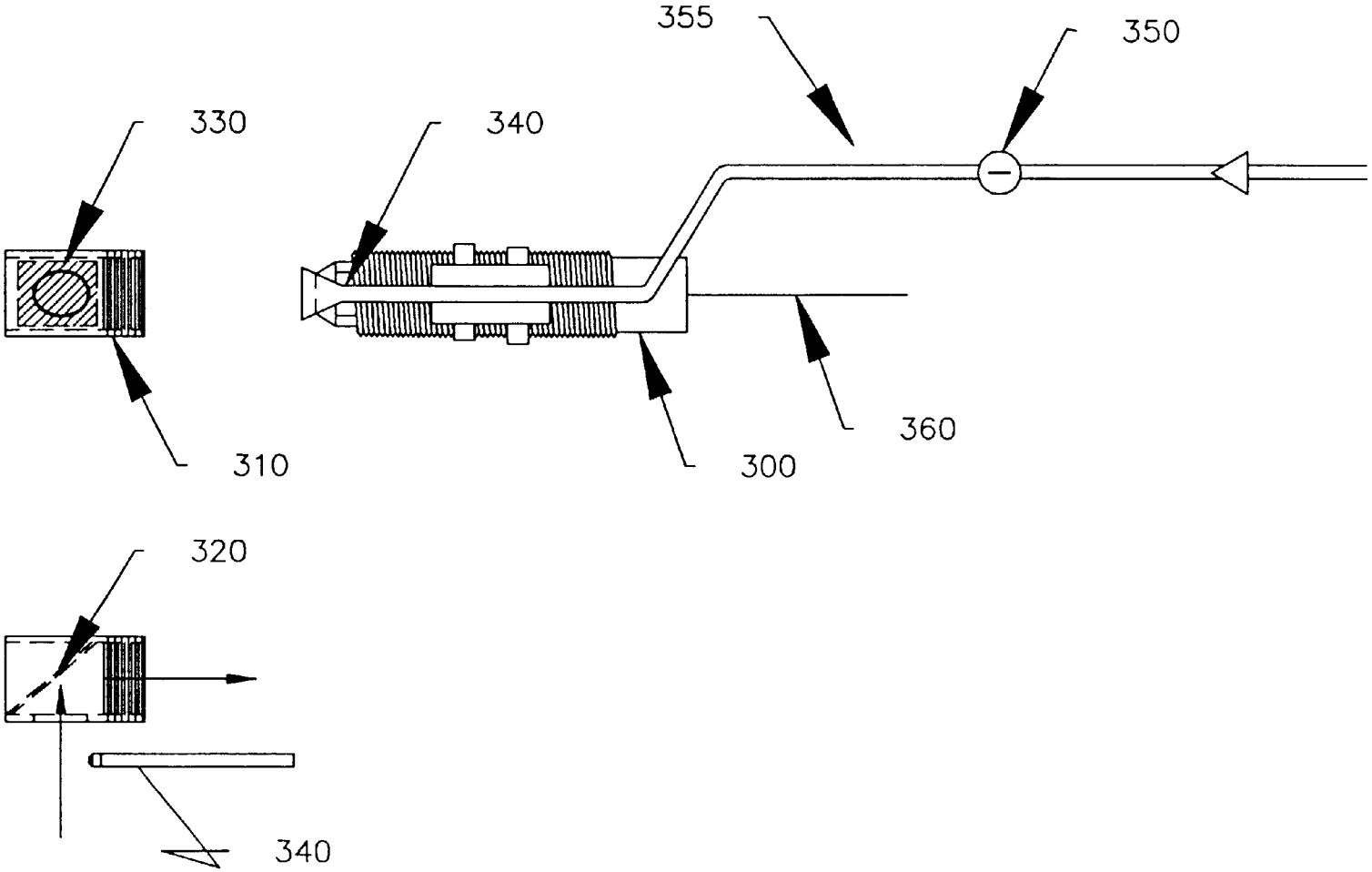
FIG. 9 shows the modifications to the preferred non-contact infrared temperature sensor.

In the previously described eight aspects, the preferred embodiment of this present invention includes the use of commercially available infrared (IR) temperature sensors. The ninth aspect of the present invention, illustrated in FIG. 9, exhibits a means to assure the operational integrity of these infrared measuring devices using an air curtain to protect them from misting created by the ink droplets suspend in the pressroom environment and other air borne contaminants that would interfere with their accuracy. The typical infrared mirror type sensor design is a main cylindrical sensor body 300 and the hollowed out cylindrical mirror cap assembly 310. In the cylindrical mirror cap assembly 310, a mirror 320 is positioned at a 45° degree angle to deflect the infrared temperature wave of the surface being monitored after passing through the oval aperture 330. This infrared mirror type sensor design is known prior art. When the cylindrical mirror assembly 310 is tightly screwed onto the infrared sensor main cylindrical body 300, the preferred embodiment of this present invention includes an air tube 340 fixed to the outer surface of the main cylindrical body 300 and protrudes at the forward edge of the oval aperture 330 in the mirror assembly 310. Clean dry air is issued through air tube 355 from an air regulator 350 to the infrared main cylindrical body 300 and this for a plurality of infrared sensor assemblies. Alternatively, the clean dry pressurized air can be input into the mirror assembly 310 or the main infrared cylinder body 300 so that this air flows out of the elliptical aperture 330 into the pressroom, the object being to prevent the admission of all air borne contaminates into the infrared sensor monitoring circuit. Further, the preferred embodiment of this present invention includes software to factory calibrate and recalibrate each infrared sensor in the field so that it will accurately monitor process temperatures to ±2° F. This is important since infrared sensors are typically manufactured with a ±4° F. variance or accuracy. However, the repeatability of a quality infrared sensor is ±1° F. and this fact of known art is used to conform to the ±2° F. process temperature control that is required. However, any temperature sensor is covered by this present invention such as thermocouples as long as their accuracy conforms to the rigid process temperature control of ±2° F.

In the first seven aspects of the present invention, the preferred heating/cooling source is a central heat pump design. This heat pump design is the tenth aspect of the present invention as illustrated in FIG. 10. FIG. 10 shows the refrigerant flow in dark relief and the external coolant flow of the heat pump design 50 of the first seven aspects in light relief. In the cooling mode, the refrigerant is compressed at the scroll compressor 400, conduited through the four way valve 410 to an air cooled condenser 420 and then through check valve 430 to receiver tank 440, a filter drier 450, fluid sight glass 460, a liquid line solenoid valve 470, to check valve 472 to a thermostatic expansion valve 475, and finally to plate heat exchanger 42 which serves as a refrigerant evaporator. The refrigerant evaporator removes heat absorbed by the external coolant at the rotary printing press (shown in light relief on FIG. 10) flowing from pump 26 via flow regulator 40 to plate heat exchanger 42 before said coolant returns to coolant reservoir 36 of the first seven aspects of this present invention. The warmer refrigerant issued from heat exchanger 42 then returns on conduit 416 to the four way valve 410 and loops back on conduit 417 to a refrigerant low-pressure switch 490 en route to a pressure regulator 500 and back to the scroll compressor 400 from which this refrigerant cycle repeatedly takes place. In the heating mode, the four way valve is automatically turned 90 degrees so that the hot refrigerant discharged from scroll compressor 400 is issued to the heat exchanger 42 where the refrigerant loses heat to the external coolant from pump 26 that passes on the other side of the plate heat exchanger 42. In this case, the refrigerant then passes through check valve 510, items 440, 450, 460 and 470 through check valve 520 and then through the thermostatic heating expansion valve 530. Then the refrigerant passes through the condenser 420 which acts as a refrigerant evaporator by heating the cooler refrigerant gas using the ambient air as a heat source. The refrigerant then passes through the four-way valve 410 to refrigerant low-pressure switch 490 and back through the pressure regulator 500 to the suction of the scroll compressor 400. If it is desired to generate less cooling capacity, the refrigerant gas issued from the scroll compressor 400 proportionally bypasses the condenser 420 by opening a modulating actuator valve 540 coupled to CPU programmed to open and closed actuator valve 540. When the heat load generated by a rotary machine in real time is lower than half the design cooling tonnage of its heat pump, the scroll compressor will short cycle (start and stop too often). To avoid this fatal short cycling, the hot refrigerant gas bypass actuator valve opens under CPU/PID control. As a result, less refrigerant gas circulates through the cooling circuit which reduces the cooling power available for external coolant at heat exchanger 480. Most importantly, this bypass actuator valve 540 is opened or closed, incrementally and proportionally, to balance cooling loads to match the variable heat loads created in the printing process in real-time. Since a printing rotary machine typically runs at assorted operating press speeds, with changing ink coverages depending on the print job and its colors and with frequent stops/starts, automated capability to match cooling loads to actual heat loads is a very significant and positive aspect of this invention to dampen the temperature swings of the process temperature control systems of this invention in real-time.

In an eleventh aspect of the present invention, illustrated in FIG. 11.1, the preferred embodiment of all aspects of the present invention includes a programmable logic computer (PLC) as the temperature controller 46 coupled to a remote touch screen 49. The actual temperature reading in real-time at each temperature thermocouple and infrared sensor are received by the PLC 46 and transmitted to the touch screen 49. At touch screen 49, the desired temperature at each temperature sensing point is input manually using an up arrow 625 and down arrow 635 system as shown on FIG. 11.2 illustrating the touch screen for the infrared sensors 44, a to z, of the first aspect of this present invention where the press units a to z are shown as unit 1 to 7 and where the actual temperatures 700 and set temperatures 600 are displayed. This main screen is customer designed to suit the aspect of this present invention being used. There are too many permutations and combinations to have a fixed set of touch screen layouts and because it is essential that the visual display is simple and straight forward for each application. Upon the issuance of an alarm from a process temperature control system of this present invention generated at the PLC 46, touch screen 49 flashes on and off to augment an audible alarm signal. In such cases, the operator merely touches the alarm button 652 and a diagnostic screen appears such as shown in FIG. 11.5 and FIG. 11.6. Additional touch screen menus are easily accessible at 655 such as the setup screen, FIG. 11.3 and the sensor calibration screen, FIG. 11.4. These additional touch screens are typically utilized to set up the process temperature control system. In the setup screen, the heat pump design of the preferred embodiment of this present invention may be set in Celsius or Fahrenheit readings 660 as shown in FIG. 11.3 or put into cooling or heating mode 665. Similarly, the set temperature of the external coolant supplied by the heat pump design to the printing press by pump 26 is selected using up and down arrows 670. Also, the external coolant temperature entering the heat exchanger 42 as read by thermocouple 43 and exiting the heat exchanger 42 as read by thermocouple 47 are displayed at 675 of setup screen FIG. 11.3. Of course, the infrared sensor calibration touch screen FIG. 11.4 is important when setting up a process temperature control system to easily ensure that the process operating data accurately reflect real process temperature conditions. The PLC 46 is fitted with an appropriate set of software programs to automatically control the operation of each process temperature control system. As an example, assuming a seven-press unit multi-zone ink vibrator roller train temperature control system. (the first aspect of this present invention shown in FIG. 1) and assuming that the press operator detects a print color quality arising at press unit 10, he may decide to incrementally increase or decrease the temperature setting at press unit 10 using touch arrows 625 or 635, respectively, on to the main screen shown in FIG. 11.2. Alternatively, he may decide that the temperature control system is not reacting well in real-time to production conditions of press speed, ink coverage or the pressroom environment and choose to increase or decrease the general cooling/heating power being supplied by increasing or decreasing the external coolant temperature at reservoir 36 (this being the temperature of the external coolant being supplied to the printing press) as shown on the setup screen, FIG. 11.3 at 675. This capacity to use process temperature adjustments to deal with actual print quality drifts in real-time is a new and innovated rotary press operating feature of this present invention that vastly reduces the frequency of having to make mechanical press adjustments which often complicate the process and are nothing more than indirect actions made necessary because the process temperatures have changed. This new process capability to use process temperature adjustments as a means to control print quality drifts in real-time necessitates the use of rapid temperature monitoring and quick acting automated cooling/heating rate changes. In turn, the known prior art of PLC and Touch Screen monitoring are important features to this present invention that generate original means of process temperature control.

As a final and twelfth aspect of this present invention, the quick acting nature of solenoid valves, which are themselves known art, are an important preferred embodiment of the present invention although any other means that instantaneously provides full or no flow commands are also covered by this invention. Solenoid valves are preferred since they meet the requirements of quick action, low cost and ease of maintenance. However, solenoid valves as per known prior art are not sufficient since any one of them may fail to open or close as commanded. Such malfunctions cannot be quickly detected without basic design enhancements and the absence of rapid identification of any malfunction is vital to process temperature control in real time. To overtone this critical deficiency of solenoid valves, the twelfth aspect of this present invention includes a thermocouple mounted on the body of each solenoid valve where said thermocouples are coupled to the temperature controller PLC 46 as indicated in FIG. 11.1. In any process temperature control system of this present invention, the body of each solenoid has its own specific temperature fingerprint for its open or closed position in its electrically energized (or not) status. As an example, a normally open solenoid valve in a cooling mode status runs cooler when it is energized to close but fails to do so as compared to its temperature when it closes as it should. In this malfunctioning circumstance, the external coolant continues to flow and this, in turn, cools the solenoid body to a lower temperature than if it had not malfunctioned. Similarly, a normally closed solenoid runs warmer if it malfunctions when energized and fails to open. By the same process, a non-energized normally open solenoid valve runs warmer and a non-energized normally closed solenoid valve runs cooler, when either malfunctions. This temperature fingerprint applies whether a malfunction is caused by a failure of its electrical activation coil or a purely mechanical failure of a solenoid valve. Accordingly, the software program to monitor said temperature fingerprints of this invention is pre-set temperature values for each solenoid valve or self learned values determined by the actual temperature fingerprint established by its last, or last few, open/closed cycles. In all such malfunctions, the PLC 46 provides an immediate alarm status at touch screen 49 identifying the specific location of the problem solenoid valve.

It will be understood that the above described embodiments are for purposes of illustration only and that changes and modifications may be made thereto without departing from the spirit and scope of the invention.

We claim:

1. A system for controlling the temperature of a rotary machine having a hollow roller train with vibratory rollers and a plate cylinder, the system comprising:

a heat transfer fluid;

a reservoir for said heat transfer fluid;

means for cooling said heat transfer fluid;

closed loop conduit means extending from said reservoir to said ink vibratory rollers and returning to said reservoir;

means for pumping said heat transfer fluid through said closed loop conduit means;

a solenoid valve mounted on said conduit means; temperature sensing means to sense the temperature of at least one of said ink vibratory rollers;

control means operative to either fully open or fully close said solenoid valve; and bypass means operatively connected to said closed loop conduit means to bypass heat transfer fluid flow from said ink vibratory rollers when said solenoid valve is closed.

2. The system of claim 1 further including a plurality of roller trains each having at least one solenoid valve, and a central temperature controller connected so as to control each of said solenoid valves.

3. The system of claim 2 wherein said system further includes a bypass solenoid valve working in conjunction with the plurality of solenoid valves to provide a continuous uninterrupted supply of heat transfer fluid.

4. The system of claim 2 wherein said solenoid valves are operative to control the cooling of a plurality of press units.

5. The system of claim 1 wherein said temperature sensing means comprise infrared temperature sensors, and means for directing clean pressurized air at each of said infrared temperature sensors to prevent the admission of air borne contaminants.

* * * * *